US010245860B2

(12) United States Patent
Kodama et al.

(10) Patent No.: US 10,245,860 B2
(45) Date of Patent: Apr. 2, 2019

(54) INTERMEDIATE UNIT, POST PROCESSING DEVICE, AND PRINTING APPARATUS

(71) Applicant: SEIKO EPSON CORPORATION, Tokyo (JP)

(72) Inventors: Hidetoshi Kodama, Nagano (JP); Kazuyoshi Ohashi, Nagano (JP); Hirohisa Adachi, Matsukawa-machi (JP); Akinori Muromachi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 15/642,630

(22) Filed: Jul. 6, 2017

(65) Prior Publication Data

US 2018/0015747 A1 Jan. 18, 2018

(30) Foreign Application Priority Data

Jul. 13, 2016 (JP) ..... 2016-138257
Apr. 28, 2017 (JP) ..... 2017-089383

(51) Int. Cl.

| | |
|---|---|
| ***B41J 13/26*** | (2006.01) |
| ***G03G 15/00*** | (2006.01) |
| ***B41J 2/005*** | (2006.01) |
| ***B41J 13/10*** | (2006.01) |
| ***B65H 29/12*** | (2006.01) |
| ***B65H 5/06*** | (2006.01) |
| ***B65H 9/00*** | (2006.01) |
| ***B65H 29/60*** | (2006.01) |
| ***B65H 85/00*** | (2006.01) |

(52) U.S. Cl.

CPC ..... *B41J 13/26* (2013.01); *B41J 2/0057* (2013.01); *B41J 13/106* (2013.01); *B65H 5/062* (2013.01); *B65H 9/006* (2013.01); *B65H 29/125* (2013.01); *B65H 29/60* (2013.01); *B65H 85/00* (2013.01); *G03G 15/6573* (2013.01); *B65H 2301/33312* (2013.01); *B65H 2301/517* (2013.01); *B65H 2402/10* (2013.01); *B65H 2404/1115* (2013.01); *B65H 2404/133* (2013.01); *B65H 2404/143* (2013.01); *B65H 2404/5212* (2013.01); *B65H 2801/27* (2013.01); *G03G 15/6538* (2013.01); *G03G 15/6567* (2013.01)

(58) Field of Classification Search

CPC ..... G03G 15/6567; G03G 15/6558; G03G 15/6576; B41J 11/0005; B65H 5/36; B65H 29/52

See application file for complete search history.

(56) References Cited

U.S. PATENT DOCUMENTS 6,308,026 B1 10/2001 Kouchi
6,460,687 B1 10/2002 Escobedo et al.
(Continued)

FOREIGN PATENT DOCUMENTS

JP 2013-006322 A 1/2013
JP 2015-107840 A 6/2015
(Continued)

OTHER PUBLICATIONS

The Extended European Search Report for the corresponding European Patent Application No. 171804362 dated Dec. 8, 2017.

*Primary Examiner* — Henok D Legesse

(57) ABSTRACT

A medium, of which skew is appropriately corrected, is fed from an intermediate unit to a post processing unit so as to suppress an adverse effect of the skew of the medium in the post processing unit.

22 Claims, 14 Drawing Sheets

(56) References Cited

U.S. PATENT DOCUMENTS

| | | | | |
|---|---|---|---|---|
| 6,554,216 | B1 * | 4/2003 | Escobedo | B41J 11/46 198/624 |
| 2002/0109289 | A1 * | 8/2002 | Oikawa | B65H 39/10 271/298 |
| 2007/0048048 | A1 | 3/2007 | Kougami et al. | |
| 2008/0224386 | A1 | 9/2008 | Kunieda et al. | |
| 2009/0184466 | A1 | 7/2009 | Maeda et al. | |
| 2010/0002037 | A1 | 1/2010 | Kusuhata | |
| 2011/0140343 | A1 | 6/2011 | Tanaka et al. | |
| 2011/0229240 | A1 | 9/2011 | Shibayama | |
| 2013/0004652 | A1 | 1/2013 | Furukawa | |
| 2014/0062005 | A1 | 3/2014 | Suzuki et al. | |
| 2014/0354728 | A1 | 12/2014 | Murata et al. | |
| 2015/0116411 | A1 | 4/2015 | Suzuki | |
| 2015/0151944 | A1 | 6/2015 | Shirasaki et al. | |
| 2015/0266320 | A1 | 9/2015 | Kokura | |
| 2016/0023858 | A1 | 1/2016 | Mizuno | |
| 2016/0031234 | A1 | 2/2016 | Segawa | |

FOREIGN PATENT DOCUMENTS

| | | | |
|---|---|---|---|
| JP | 2015-174331 | A | 10/2015 |
| JP | 2015-174726 | A | 10/2015 |

* cited by examiner

INTERMEDIATE UNIT, POST PROCESSING DEVICE, AND PRINTING APPARATUS

BACKGROUND

1. Technical Field

The present invention relates to an intermediate unit, a post processing device in which the intermediate unit is installed, and a printing apparatus in which the post processing device is installed.

2. Related Art

In the related art, there is known a printing system (printing apparatus) including a multifunction machine (image forming apparatus) that prints an image on a paper sheet, which is an example of a medium, and a post processing device that performs post processing such as a punching process or a stapling process with respect to the paper sheet on which the image has been printed (refer to JP-A-2015-107840).

The printing system (printing apparatus) described in JP-A-2015-107840 includes a multifunction machine (image forming apparatus) that prints an image on a paper sheet, a post processing device that performs post processing with respect to the paper sheet on which the image has been printed, and a relay unit (intermediate unit) that constitutes a transportation path between the multifunction machine and the post processing device. The post processing device includes an alignment member and the post processing is performed in a state where paper sheets are aligned by the alignment member.

Meanwhile, in the image forming apparatus and the intermediate unit, skew, in which a paper sheet is transported in a direction oblique with respect to a transportation direction of the paper sheet, is likely to occur due to various reasons such as eccentricity of a rotation axis of a roller transporting the paper sheet or curling of the paper sheet. In the printing apparatus described in JP-A-2015-107840, in a case where the degree of skew of the paper sheet transported into the post processing device from the intermediate unit is significantly great, there is a possibility that it is difficult to appropriately perform alignment by using the alignment member and it is difficult to appropriately perform the post processing such as the punching process and the stapling process.

SUMMARY

The invention can be realized in the following aspects or application examples.

Application Example 1

According to this application example, there is provided an intermediate unit including a carry-in port through which a medium is transported into the intermediate unit from a printing unit that ejects liquid to print an image on the medium, a carry-out port through which the medium is transported to a post processing unit that performs post processing on the medium, and a transportation path that is disposed between the carry-in port and the carry-out port, in which the transportation path is provided with a group of pairs of first transportation rollers that is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller, and a pair of correction rollers that is positioned on the downstream side of the group of pairs of first transportation rollers in the transportation direction and corrects skew of the medium with respect to the transportation direction.

For example, if the liquid is aqueous ink and an image is formed on the medium by means of the aqueous ink, the medium absorbs moisture of the aqueous ink and the medium swells. Furthermore, the swelling state of the medium is different between a portion on which a large amount of aqueous ink is ejected and a dense image is formed and a portion on which a small amount of aqueous ink is ejected and a light image is formed and thus the medium is likely to curl (be curved) due to the partial difference in swelling state.

Furthermore, the curling state of the medium depends on difference in swelling state and thus the medium which has curled in various ways is transported into the intermediate unit from the printing unit and is transported along the transportation path in the intermediate unit.

If the curled medium is transported to the transportation path in the intermediate unit, it is difficult for the pair of transportation rollers to uniformly nip the medium and to apply the transportation force in the transportation direction to the medium and thus the skew of the medium with respect to the transportation direction becomes likely to occur. However, since the pair of correction rollers is provided, even in a case where the skew of the medium occurs in the transportation path, the medium can be transported out of the carry-out port with the skew of the medium with respect to the transportation direction being corrected.

Application Example 2

In the intermediate unit according to the application example, the pair of correction rollers is preferably disposed such that, when the smallest medium that is transported is transported, a leading end of the smallest medium reaches the carry-out port while the smallest medium is transported by being nipped by the pair of correction rollers.

The pair of correction rollers is disposed such that the leading end of the medium reaches the carry-out port while the medium is transported by being nipped by the pair of correction rollers. In other words, the pair of correction rollers is disposed close to the carry-out port. Since the pair of correction rollers that corrects the skew of the medium is disposed close to the carry-out port, even in a case where the skew of the medium occurs in the transportation path, the medium can be transported out of the carry-out port with the skew of the medium with respect to the transportation direction being corrected.

Application Example 3

In the intermediate unit according to the application example, the pair of correction rollers preferably includes a first roller which rotates in a direction in which the medium is transported toward the carry-out port and a second roller which is rotated in accordance with the rotation of the first roller with the medium nipped between the first roller and the second roller, and the first roller preferably includes a surface on which a convex portion that comes into point contact with the medium is provided.

Since the first roller comes into point contact with the medium, the contact area between the first roller and the medium is small in comparison with a case where the first roller comes into surface contact with the medium and dirt on the medium is not likely to be transferred to the first roller. Furthermore, since the first roller is disposed such that the convex portion bites into the medium in a case where the medium is transported by being nipped between the first roller and the second roller and the first roller is not likely to slide on the medium, it is possible to stably transport the medium.

Application Example 4

In the intermediate unit according to the application example, the group of pairs of first transportation rollers is preferably configured of a plurality of pairs of first transportation rollers which are driven by the same motor, the group of pairs of first transportation rollers preferably includes an upstream side pair of first transportation rollers which is disposed on the upstream side of the pair of correction rollers in the transportation direction, and a downstream side pair of first transportation rollers which is disposed on the upstream side of the pair of correction rollers in the transportation direction and is disposed on the downstream side of the upstream side pair of first transportation rollers in the transportation direction, and, in a case where the skew is corrected, a transportation force which is applied to the medium by the downstream side pair of first transportation rollers is preferably released after a transportation force which is applied to the medium by the upstream side pair of first transportation rollers is released.

If the transportation force in the transportation direction which is applied to the medium by the downstream side pair of first transportation rollers is released earlier and the transportation force in the transportation direction which is applied to the medium by the upstream side pair of first transportation rollers is released later in a case where the skew of the medium is corrected, the medium warps at a position between the downstream side pair of first transportation rollers and the upstream side pair of first transportation rollers and thus transportation failure such as a jam of the medium is likely to occur.

Therefore, in a case where the skew of the medium is corrected, the transportation force in the transportation direction which is applied to the medium by the upstream side pair of first transportation rollers is released earlier and the transportation force in the transportation direction which is applied to the medium by the downstream side pair of first transportation rollers is released later so that the medium is not likely to warp at a position between the downstream side pair of first transportation rollers and the upstream side pair of first transportation rollers and transportation failure such as a jam of the medium is not likely to occur.

Application Example 5

The intermediate unit according to the application example preferably further includes a group of pairs of second transportation rollers that is disposed on the upstream side of the group of pairs of first transportation rollers in the transportation direction and in which a plurality of pairs of transportation rollers that are driven by the same motor are disposed. A distance between a pair of first transportation rollers which is disposed on the most upstream side in the group of pairs of first transportation rollers and a pair of second transportation rollers which is disposed on the most downstream side in the group of pairs of second transportation rollers is preferably greater than a distance between a pair of first transportation rollers which is disposed on the most downstream side in the group of pairs of first transportation rollers and the pair of correction rollers.

If an end of the medium is pressed against a nip position of the pair of correction rollers by driving the group of pairs of first transportation rollers in a state where the driving of the pair of correction rollers is stopped, the skew of the medium (hereinafter, referred to as first medium) is corrected. That is, the skew of the first medium is corrected in a state where transportation of the first medium is stopped.

The group of pairs of second transportation rollers transports the next medium (hereinafter, referred to as second medium) and when the skew of the first medium is corrected, the group of pairs of second transportation rollers feeds the second medium to the group of pairs of first transportation rollers so that the skew of the second medium is corrected by the pair of correction rollers.

If a distance between the group of pairs of first transportation rollers and the group of pairs of second transportation rollers is set to be short, the second medium may interfere with the first medium in a case where the skew of the first medium is corrected with the group of pairs of second transportation rollers being driven. Therefore, it is necessary to stop transportation of the second medium performed by the group of pairs of second transportation rollers as well.

If a distance between the group of pairs of first transportation rollers and the group of pairs of second transportation rollers is set to be long, the second medium is not likely to interfere with the first medium even in a case where the skew of the first medium is corrected with the group of pairs of second transportation rollers being driven and the transportation of the second medium performed by the group of pairs of second transportation rollers is continued. Therefore, it is not necessary to stop the transportation of the second medium performed by the group of pairs of second transportation rollers. Accordingly, it is not necessary to stop the transportation of the second medium performed by the group of pairs of second transportation rollers in a case where the skew of the first medium is corrected and thus it is possible to improve the transportation ability in the transportation path in comparison with a case where the transportation of the second medium performed by the group of pairs of second transportation rollers is stopped.

Accordingly, it is preferable that the distance between the group of pairs of first transportation rollers and the group of pairs of second transportation rollers be greater than a distance between the group of pairs of first transportation rollers and the pair of correction rollers.

Application Example 6

According to this application example, there is provided a post processing device including the intermediate unit according to any one of the above-described examples, a mounting portion that is disposed on the downstream side of the intermediate unit in the transportation direction and on which the medium transported out of the carry-out port is mounted, and a post processing unit that includes a post processing portion which performs post processing on the medium mounted on the mounting portion.

Since the pair of correction rollers that corrects the skew of the medium is provided close to the carry-out port, even in a case where the skew of the medium occurs in the transportation path of the intermediate unit, the medium is mounted on the mounting portion with the skew of the medium with respect to the transportation direction being corrected and thus it is possible to appropriately perform the post processing on the medium by using the post processing portion.

Application Example 7

According to this application example, there is provided a post processing device including a group of pairs of transportation rollers that transports a medium, which is transported into the post processing device from a printing unit that ejects liquid to print an image on the medium, in a transportation direction and is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller, a mounting portion on which the medium is mounted, and a post processing portion that performs post processing on the medium mounted on the mounting portion, in which a pair of correction rollers that corrects skew of the medium with respect to the transportation direction is provided between the group of pairs of transportation rollers and the mounting portion.

Since the pair of correction rollers that corrects the skew of the medium is provided between the group of pairs of transportation rollers and the mounting portion in the post processing device, in a case where the skew of the medium occurs, the medium is mounted on the mounting portion with the skew of the medium being corrected and thus it is possible to appropriately perform the post processing on the medium by using the post processing portion.

Application Example 8

The post processing device according to the application example preferably further includes a pair of mounting portion side transportation rollers that is provided between the group of pairs of transportation rollers and the mounting portion. The pair of correction rollers is preferably disposed such that, when the smallest medium that is transported is transported, a leading end of the smallest medium reaches the pair of mounting portion side transportation rollers while the smallest medium is transported by being nipped by the pair of correction rollers.

The pair of correction rollers is disposed such that the leading end of the medium reaches the pair of mounting portion side transportation rollers while the medium is transported by being nipped by the pair of correction rollers. In other words, the pair of correction rollers is disposed close to the pair of mounting portion side transportation rollers. Since the pair of correction rollers is disposed close to the pair of mounting portion side transportation rollers, even in a case where the skew of the medium occurs, the medium is transported to the pair of mounting portion side transportation rollers and is mounted on the mounting portion with the skew of the medium being corrected more appropriately than in a case where the pair of correction rollers is disposed distant from the pair of mounting portion side transportation rollers.

Since the medium is mounted on the mounting portion with the skew of the medium being corrected more appropriately, it is possible to more appropriately perform the post processing on the medium by using the post processing portion.

Application Example 9

According to this application example, there is provided a printing apparatus including the post processing device according to any one of the application examples, and a printing unit that is disposed on the upstream side of the post processing device in the transportation direction and ejects liquid to print an image on the medium.

Even in a case where an image is formed on the medium in the printing unit under conditions on which the medium is likely to swell and the skew of the medium is likely to occur due to the swelling of the medium in the intermediate unit, since the pair of correction rollers that corrects the skew of the medium is provided close to the carry-out port, the medium is mounted on the mounting portion with the skew of the medium being corrected and thus it is possible to appropriately perform the post processing on the medium by using the post processing portion.

Accordingly, an adverse effect of the skew of the medium in the printing apparatus (post processing device) is suppressed and thus it is possible to appropriately perform the post processing on the medium.

Application Example 10

According to this application example, there is provided a printing apparatus including a printing portion that ejects liquid to print an image on a medium, a group of pairs of transportation rollers that is provided with a plurality of pairs of transportation rollers, each of which includes a driving roller that applies a transportation force in a transportation direction to the medium fed from the printing portion and a driven roller that is rotated in accordance with the rotation of the driving roller with the medium nipped between the driving roller and the driven roller, a mounting portion on which the medium is mounted, and a post processing portion that performs post processing on the medium mounted on the mounting portion, in which a pair of correction rollers that corrects skew of the medium with respect to the transportation direction is provided between the group of pairs of transportation rollers and the mounting portion.

Since the pair of correction rollers that corrects the skew of the medium is provided between the group of pairs of transportation rollers and the mounting portion in the printing apparatus, in a case where the skew of the medium occurs, the medium is mounted on the mounting portion with the skew of the medium being corrected and thus it is possible to appropriately perform the post processing on the medium by using the post processing portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
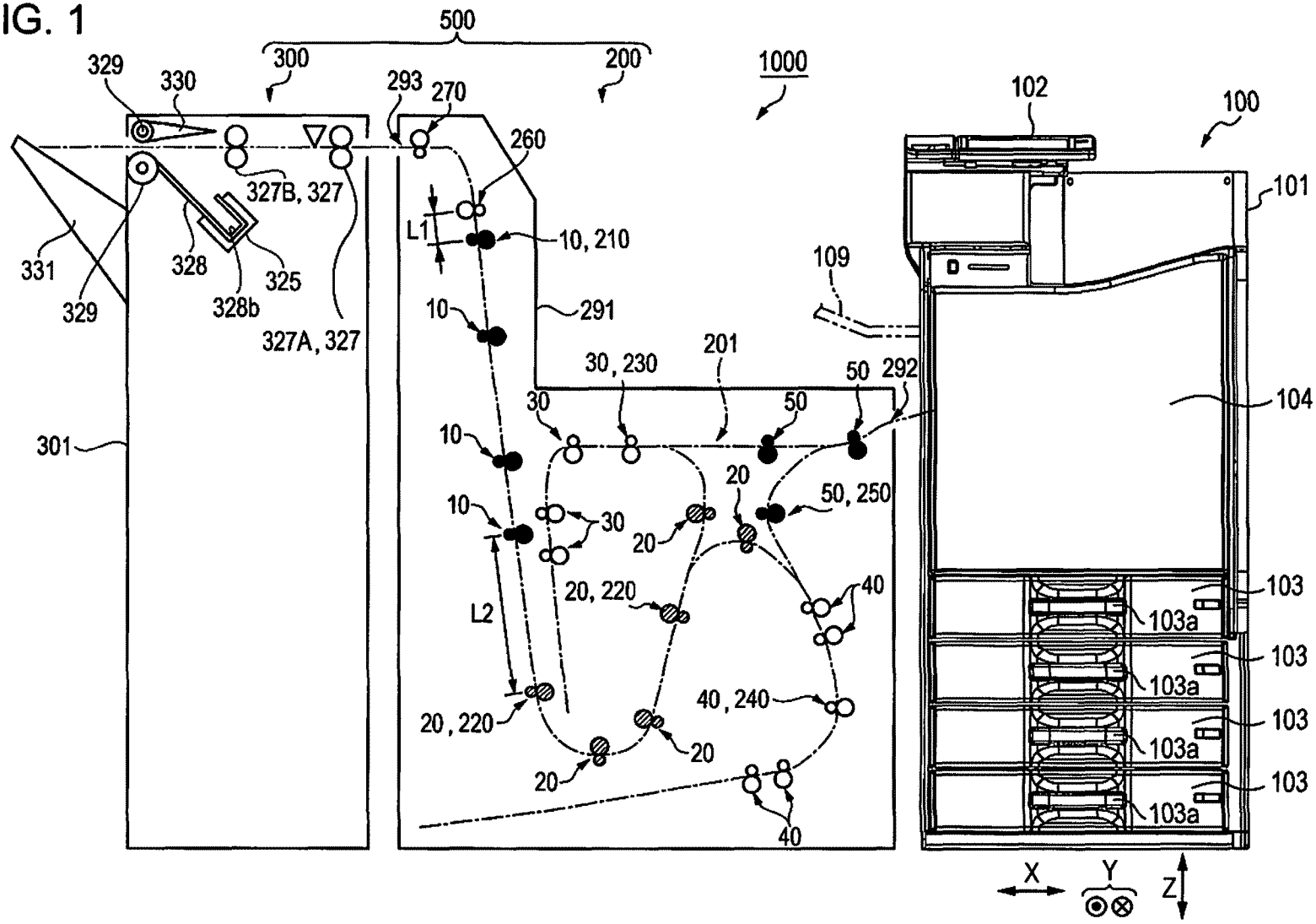
FIG. 1 is a schematic view illustrating the overview of a printing apparatus according to an embodiment.

Hereinafter, an embodiment of the invention will be described with reference to drawings. The embodiment is merely one aspect of the invention, does not limit the invention, and can be arbitrarily modified within a scope of technical ideas of the invention. In addition, in the following drawings, the scale of each layer and each member and the like is different from the actual scale so that each member and the like becomes recognizable in the drawings.

Embodiment

Outline of Printing Apparatus

FIG. 1 is a schematic view illustrating the outline of a printing apparatus according to the embodiment. First, the outline of the printing apparatus 1000 according to the present embodiment will be described with reference to FIG. 1.

As illustrated in FIG. 1, the printing apparatus 1000 is configured to include a printing unit 100 that ejects ink, which is an example of "liquid", to print an image on a paper sheet M, which is an example of a "medium", and a post processing device 500 that is disposed on the downstream side of the printing unit 100 in a transportation direction of the paper sheet M. The post processing device 500 includes an intermediate unit 200 and a post processing unit 300. The intermediate unit 200 is disposed on the upstream side in the transportation direction of the paper sheet M, dries ink ejected onto the paper sheet M, and feeds the paper sheet M in a state where skew, in which the paper sheet M is transported in a direction oblique with respect to the transportation, is corrected. The post processing unit 300 is disposed on the downstream side in the transportation direction of the paper sheet M, stacks the paper sheet M transported from the intermediate unit 200, and performs various post processing such as a stapling process and a punching process with respect to the paper sheet M.

That is, the printing apparatus 1000 includes the post processing device 500 which is configured of the intermediate unit 200 and the post processing unit 300 and the printing unit 100 which is disposed on the upstream side of the post processing device 500 in the transportation direction of the paper sheet M and ejects ink to print an image on the paper sheet M.

The printing unit 100 includes a housing 101 that has a rectangular parallelepiped shape, an operation unit 102 which is disposed on the upper portion of the housing 101 in a vertical direction Z, and paper sheet cassettes 103 which are provided in an area from the central portion to the lower portion of the printing unit 100. Four paper sheet cassettes 103 are arranged in the vertical direction Z and in each of the paper sheet cassettes 103, the paper sheets M are accommodated being in a stacked state. In addition, a grip portion 103*a* which a user can grip is provided on the central portion of each paper sheet cassettes 103 in a transverse direction X. A rectangular front plate cover 104 is provided at a position adjacent to the uppermost paper sheet cassette 103.

The intermediate unit 200 is attached to a left surface of the printing unit 100 in the transverse direction X which is an arrangement direction. The intermediate unit 200 includes a housing 291. A portion of the housing 291 on the printing unit 100 side is short in the vertical direction Z and a portion of the housing 291 on the post processing unit 300 side is long in the vertical direction Z. The housing 291 is provided with a carry-in port 292 through which the paper sheet M, on which printing has been performed in the printing unit 100, is transported into the housing 291 and a carry-out port 293 through which the paper sheet M is transported to the post processing unit 300.

The intermediate unit 200 includes a transportation path 201 which is illustrated by a dashed line in FIG. 1 and along which the paper sheet M is transported. The transportation path 201 is disposed between the carry-in port 292 and the carry-out port 293. In the transportation path 201, a group of pairs of fifth transportation rollers 250, a group of pairs of fourth transportation rollers 240 and a group of pairs of third transportation rollers 230, a group of pairs of second transportation rollers 220, a group of pairs of first transportation rollers 210, a pair of correction rollers 260, and a pair of discharging rollers 270 are sequentially disposed in the transportation direction of the paper sheet M. The paper sheet M which is transported into the intermediate unit through the carry-in port 292 is transported in the transportation direction by the group of pairs of fifth transportation rollers 250, the group of pairs of fourth transportation rollers 240 or the group of pairs of third transportation rollers 230, the group of pairs of second transportation rollers 220, the group of pairs of first transportation rollers 210, the pair of correction rollers 260, and the pair of discharging rollers 270 so that the paper sheet M is transported to the post processing unit 300 through the carry-out port 293.

The group of pairs of first transportation rollers 210 includes a plurality of pairs of first transportation rollers 10 which are disposed on the upstream side of the pair of correction rollers 260 in the transportation direction of the paper sheet M and are driven by the same motor (not shown). The group of pairs of second transportation rollers 220 includes a plurality of pairs of second transportation rollers 20 which are disposed on the upstream side of the group of pairs of first transportation rollers 210 in the transportation direction of the paper sheet M and are driven by the same motor (not shown). The group of pairs of third transportation rollers 230 includes a plurality of pairs of third transportation rollers 30 which are disposed on the upstream side of the group of pairs of second transportation rollers 220 in the transportation direction of the paper sheet M and are driven by the same motor (not shown). The group of pairs of fourth transportation rollers 240 includes a plurality of pairs of fourth transportation rollers 40 which are disposed on the upstream side of the group of pairs of second transportation rollers 220 in the transportation direction of the paper sheet M and are driven by the same motor (not shown). The group of pairs of fifth transportation rollers 250 includes a plurality of pairs of fifth transportation rollers 50 which are disposed on the upstream side of the group of pairs of third transportation rollers 230 and the group of pairs of fourth transportation rollers 240 in the transportation direction of the paper sheet M and are driven by the same motor (not shown).

The pair of correction rollers 260 is disposed on the downstream side of the group of pairs of first transportation rollers 210 in the transportation direction of the paper sheet M while being positioned in the vicinity of the carry-out port 293 and corrects skew of the paper sheet M, in which the paper sheet M is transported in a direction oblique with respect to the transportation direction.

Furthermore, a distance L2 between the group of pairs of first transportation rollers 210 and the group of pairs of second transportation rollers 220 is greater than a distance L1 between the group of pairs of first transportation rollers 210 and the pair of correction rollers 260.

The post processing unit 300 is attached to a left surface of the intermediate unit 200 in the transverse direction X which is an arrangement direction and includes a housing 301 that has a rectangular parallelepiped shape. Furthermore, the post processing unit 300 includes a group of pairs of post processing transportation rollers 327, a guiding unit 330, a stacker 328, a pair of discharging rollers 329, and a discharging tray 331, which are sequentially disposed in the transportation direction of the paper sheet M that is illustrated by the dashed line in FIG. 1.

The group of pairs of post processing transportation rollers 327 is configured of a pair of first post processing transportation rollers 327A which is disposed close to the carry-out port 293 and a pair of second post processing transportation rollers 327B which is disposed close to the pair of discharging rollers 329. That is, the pair of first post processing transportation rollers 327A and the pair of second post processing transportation rollers 327B are sequentially disposed in a direction from the carry-out port 293 to the pair of discharging rollers 329.

Note that, the pair of first post processing transportation rollers 327A is an example of "a pair of mounting portion side transportation rollers".

The paper sheet M transported out of the intermediate unit 200 is transported to the stacker 328 via the pair of discharging rollers 329 and the guiding unit 330.

The paper sheet M, which is processed in a post processing portion 325, is temporarily mounted on the stacker 328 and the stacker 328 is an example of a "mounting portion". The stacker 328 is disposed in an oblique direction such that the stacker 328 is inclined downward toward the post processing portion 325. Therefore, one end sides of the paper sheets M mounted on the stacker 328 come into contact with a wall surface 328*b* of the stacker 328 and one end sides of the paper sheets M are aligned. When the number of paper sheets M mounted on the stacker 328 reaches a predetermined number, the post processing portion 325 performs various post processing such as the stapling process or the punching process on the paper sheets M. Thereafter, the paper sheets M which have been subject to the post processing are discharged to the discharging tray 331 with the pair of discharging rollers 329 being driven.

As described above, in the post processing unit 300, the paper sheets M transported out of the intermediate unit 200 are sequentially transported to the stacker 328 via the pair of discharging rollers 329 and the guiding unit 330 and when a predetermined number of paper sheets M are mounted on the stacker 328, the post processing portion 325 performs the post processing and the paper sheets M are discharged to the discharging tray 331 with the pair of discharging rollers 329 being driven.

Overview of Printing Unit

Figure 2:
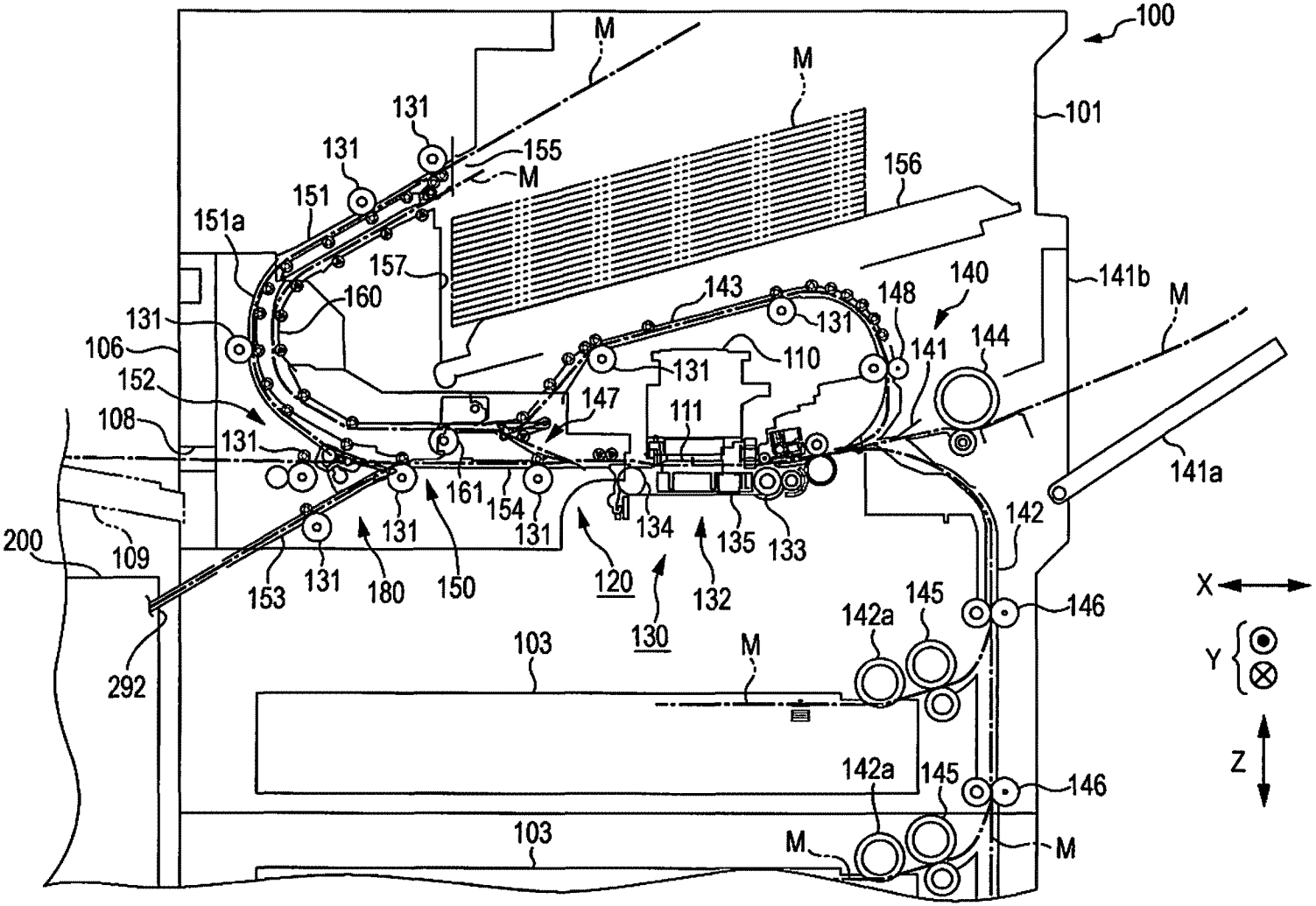
FIG. 2 is a schematic view illustrating the overview of a printing unit.

FIG. 2 is a schematic view illustrating the overview of the printing unit.

Next, the overview of the printing unit 100 will be described with reference to FIG. 2.

As illustrated in FIG. 2, in the housing 101 which is included in the printing unit 100, a printing portion 110 which performs printing on the paper sheet M while being positioned above the paper sheet M in the vertical direction Z and a transportation unit 130 which transports the paper sheet M along a transportation path 120 are provided. The transportation path 120 is formed such that the paper sheet M is transported in a transportation direction which is a direction intersecting a width direction of the paper sheet M, the width direction being a direction parallel to a front-rear direction Y.

The printing portion 110 includes a line-head type printing head 111, which can eject ink over the entire area in the width direction of the paper sheet M at once, in a lower portion thereof. The printing portion 110 prints an image on the paper sheet M by causing ink ejected from the printing head 111 to adhere (land) to a printing surface of the paper sheet M which faces the printing head 111 (surface on which image is printed).

The transportation unit 130 includes a plurality of pairs of transportation rollers 131, which are arranged along the transportation path 120, and a belt transportation unit 132 which is provided immediately below the printing portion 110. That is, printing is performed with ink being ejected from the printing head 111 to the paper sheet M, which is in a state of being transported by the belt transportation unit 132.

Ink is aqueous ink in which coloring material is dispersed (or dissolved) in an aqueous medium.

The coloring material is, for example, a dye and a direct dye, an acidic dye, an edible dye, a basic dye, a reactive dye, a disperse dye, a vat dye, a soluble vat dye, a reactive disperse dye, and the like can be used as the coloring material.

The coloring material is, for example, a pigment and an azo pigment such as an insoluble azo pigment, a condensed azo pigment, an azo lake, and a chelate azo pigment, a polycyclic pigment such as a phthalocyanine pigment, a perylene pigment, a perinone pigment, an anthraquinone pigment, a quinacridone pigment, a dioxane pigment, a thioindigo pigment, a isoindolinone pigment and a quinophthalone pigment, a dye chelate, a dye lake, a nitro pigment, a nitroso pigment, aniline black, a daylight fluorescent pigment, carbon black, a base metal pigment, and the like can be used as the coloring material.

A solvent is, for example, an aqueous medium and pure water or ultrapure water such as ion exchanged water, ultra-filtered water, reverse osmosis water, distilled water or the like can be used as the solvent. In addition, if water sterilized through ultraviolet irradiation or addition of hydrogen peroxide is used, it is possible to prevent mold and bacteria from being generated in a case where ink is preserved for a long period of time.

Note that, the solvent may contain a volatile water-soluble organic solvent such as ethylene glycol or propylene glycol.

Furthermore, ink may contain a basic catalyst, a surfactant, tertiary amine, resins, a pH conditioner, a buffer solution, a fixing agent, an antiseptic agent, an antioxidant, an ultraviolet absorber, a chelating agent, an oxygen absorber, and the like in addition to the above-described coloring materials and solvents.

The belt transportation unit 132 includes a driving roller 133 which is disposed on the upstream side of the printing head 111 in the transportation direction, a driven roller 134 which is disposed on the downstream side of the printing head 111 in the transportation direction, and an endless annular belt 135 which is suspended between the rollers 133 and 134. When the driving roller 133 rotates, the belt 135 rotates in a circumferential direction thereof and the paper sheet M is transported to the downstream side with the belt 135 rotating in the circumferential direction. That is, the outer surface of the belt 135 functions as a supporting surface which supports the paper sheet M on which printing is performed.

The transportation path 120 includes a supply path 140 along which the paper sheet M is transported to the printing portion 110, a discharging path 150 along which the paper sheet M after printing on which printing has been performed by the printing portion 110 is transported, and a branch path 160 which branches off from the discharging path 150.

The supply path 140 includes a first supply path 141, a second supply path 142, and a third supply path 143. In the first supply path 141, the paper sheet M which is inserted through an insertion port 141*b*, which is exposed when a cover 141*a* provided on a right side surface of the housing 101 is opened, is transported to the printing portion 110. That is, the paper sheet M which is inserted through the insertion port 141*b* is linearly transported to the printing portion 110 with rotation of a pair of first driving rollers 144.

In the second supply path 142, the paper sheets M which are accommodated in each of the paper sheet cassettes 103, which are provided in the lower portion of the housing 101 in the vertical direction Z, are transported to the printing portion 110. That is, the uppermost paper sheet M of the paper sheets M, which are accommodated in the paper sheet cassettes 103 in a state of being stacked, is fed by a pickup roller 142*a* and is transported to the printing portion 110 with rotation of a pair of second driving rollers 146 while being inverted in the vertical direction Z after the paper sheets M are separated from each other by a pair of separating rollers 145 in a one-by-one manner.

In the third supply path 143, in the case of duplex printing in which images are printed on both surfaces of the paper sheet M, the paper sheet M with one surface on which printing has been performed by the printing portion 110 is transported to the printing portion 110 again. That is, the branch path 160 which branches off from the discharging path 150 is provided on the downstream side of the printing portion 110 in the transportation direction. That is, when duplex printing is performed, the paper sheet M is transported to the branch path 160 with a branch mechanism 147 being operated, the branch mechanism 147 being provided in the middle of the discharging path 150. In addition, in the branch path 160, a pair of branch path rollers 161 which can be rotated forwards and backwards is provided on the downstream side of the branch mechanism 147.

When duplex printing is performed, the paper sheet M with one surface on which printing has been performed is once guided to the branch path 160 by the branch mechanism 147 and is transported to the downstream side in the branch path 160 by the pair of branch path rollers 161 rotating forwards. Thereafter, the paper sheet M which has been transported to the branch path 160 is reversely transported from the downstream side to the upstream side in the branch path 160 by the pair of branch path rollers 161 rotating backwards. That is, the transportation direction of the paper sheet M which is transported along the branch path 160 is reversed.

The paper sheet M which is reversely transported from the branch path 160 is transported to the third supply path 143 and is transported to the printing portion 110 by the plurality of pairs of transportation rollers 131. When the paper sheet M is transported along the third supply path 143, the paper sheet M is inverted such that a surface thereof on which printing has not been performed faces the printing portion 110 and the paper sheet M is transported to the printing portion 110 with rotation of a pair of third driving rollers 148. That is, the third supply path 143 functions as an inversion transportation path along which the paper sheet M is transported while being inverted in the vertical direction Z.

In the second supply path 142 and the third supply path 143 from among the supply paths 141, 142, and 143, the paper sheet M is transported to the printing portion 110 while being curved in the vertical direction Z. Meanwhile, in the first supply path 141, the paper sheet M is transported to the printing portion 110 while being curved more slightly than in the second supply path 142 and the third supply path 143.

The paper sheet M with one surface or both surfaces on which printing has been performed by the printing portion 110 and the printing is finished is transported by the pairs of transportation rollers 131 along the discharging path 150 which constitutes a downstream side portion of the transportation path 120. The discharging path 150 branches into a first discharging path 151, a second discharging path 152, and a third discharging path 153 at a position on the downstream side of a position at which the branch path 160 branches off from the discharging path 150. That is, after being transported along a common discharging path (upstream side discharging path) 154 which constitutes an upstream side portion of the discharging path 150, the paper sheet M on which printing is finished is guided by a guiding mechanism (switch guiding unit) 180 to any one of the first to third discharging paths (downstream side discharging path) 151, 152, and 153 which constitute the downstream side portion of the discharging path 150. The guiding mechanism 180 is provided at a downstream end of the common discharging path 154.

The first discharging path (upper discharging path) 151 is provided to extend to an upper portion of the housing 101 and to extend being curved along the branch path 160. The paper sheet M which is transported along the first discharging path 151 is discharged via a discharging port 155 which opens at a portion of the housing 101 so as to function as a terminal end of the first discharging path 151. In addition, the paper sheets M which are discharged through the discharging port 155 fall downward in the vertical direction Z and are discharged to a mounting table 156 in a state of being stacked as illustrated by two-dotted lines in FIG. 2. Note that, the paper sheet M is discharged by the plurality of pairs of transportation rollers 131, which are disposed in the discharging path 150, to the mounting table 156 through the discharging port 155 in such a posture that the printing surface at the time of simplex printing faces downward in the vertical direction Z.

The mounting table 156 has a tip end-rising inclined shape in which the height in the vertical direction Z increases toward the right side in a transverse direction X, and the paper sheets M are mounted on the mounting table 156 in a state of being stacked. At this time, the paper sheets M mounted on the mounting table 156 move to the left side along a slope of the mounting table 156 and are mounted being close to a vertical side wall 157 which is provided below the discharging port 155 of the housing 101.

In addition, the first discharging path 151 includes a discharging inversion path 151*a* in which the paper sheet M on which printing has been performed by the printing portion 110 is inverted upside down when the paper sheet M is transported to the discharging port 155. That is, in the discharging inversion path 151*a*, the paper sheet M on which printing has been performed by the printing portion 110 is curved with the printing surface disposed on the inner side and the paper sheet M is inverted so that a state where the printing surface of the paper sheet M faces upward in the vertical direction Z changes to a state where the printing surface faces downward in the vertical direction Z. Therefore, in the discharging path 150, the paper sheet M passes through the discharging inversion path 151*a* so that the paper sheet M is discharged through the discharging port 155 in a state where the printing surface at the time of simplex printing faces the mounting table 156.

The second discharging path 152 branches toward a lower position in the vertical direction Z than the first discharging path 151 and extends linearly from the printing portion 110 to a drawer surface portion 106 that forms a portion of the housing 101. Therefore, the paper sheet M which is transported along the second discharging path 152 is not transported being curved as in the case of the first discharging path 151 and is discharged toward a discharging tray 109, which is attached to the drawer surface portion 106, through a discharging port 108, which is formed in the drawer surface portion 106, after being linearly transported in the same posture as when passing through the printing portion 110 with the posture thereof being maintained constant. That is, the second discharging path 152 functions as a non-inversion discharging path along which the paper sheet M is transported to the discharging tray 109 with the paper sheet M being not inverted in the vertical direction.

The third discharging path 153 (lower discharging path) branches to a lower position in the vertical direction Z than the second discharging path 152 and obliquely extends downward in the vertical direction Z such that the third discharging path 153 extends toward a lower portion of the housing 101. In addition, the downstream end of the third discharging path 153 is connected to the carry-in port 292 of the intermediate unit 200.

That is, the paper sheet M which is transported along the third discharging path 153 is transported into the intermediate unit 200 through the carry-in port 292.

Overview of Intermediate Unit

Figure 3:
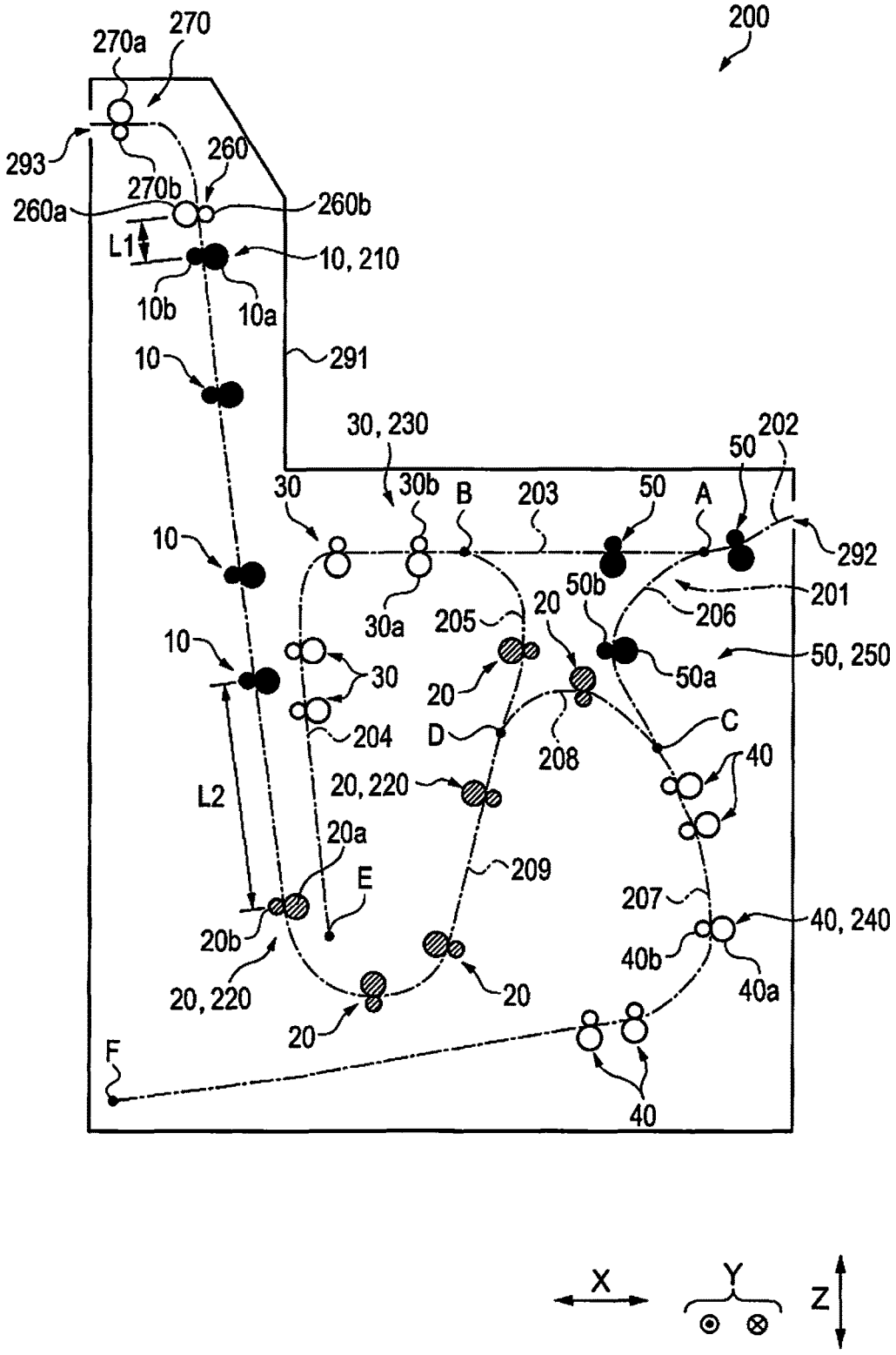
FIG. 3 is a schematic view illustrating a state of a transportation system in an intermediate unit.
Figure 4:
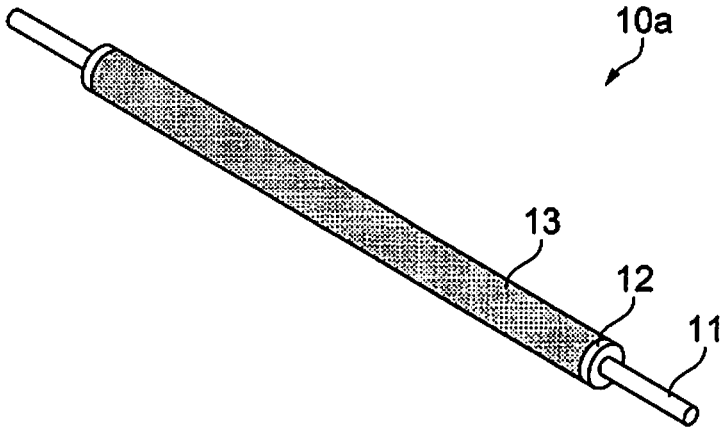
FIG. 4 is a schematic view illustrating the overview of a driving roller.
Figure 5:
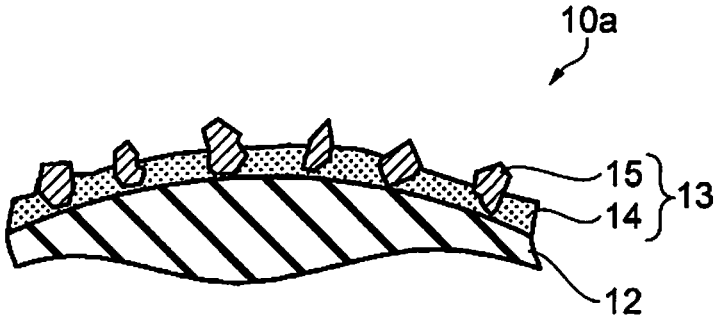
FIG. 5 is a partial enlarged view of the driving roller.
Figure 6:
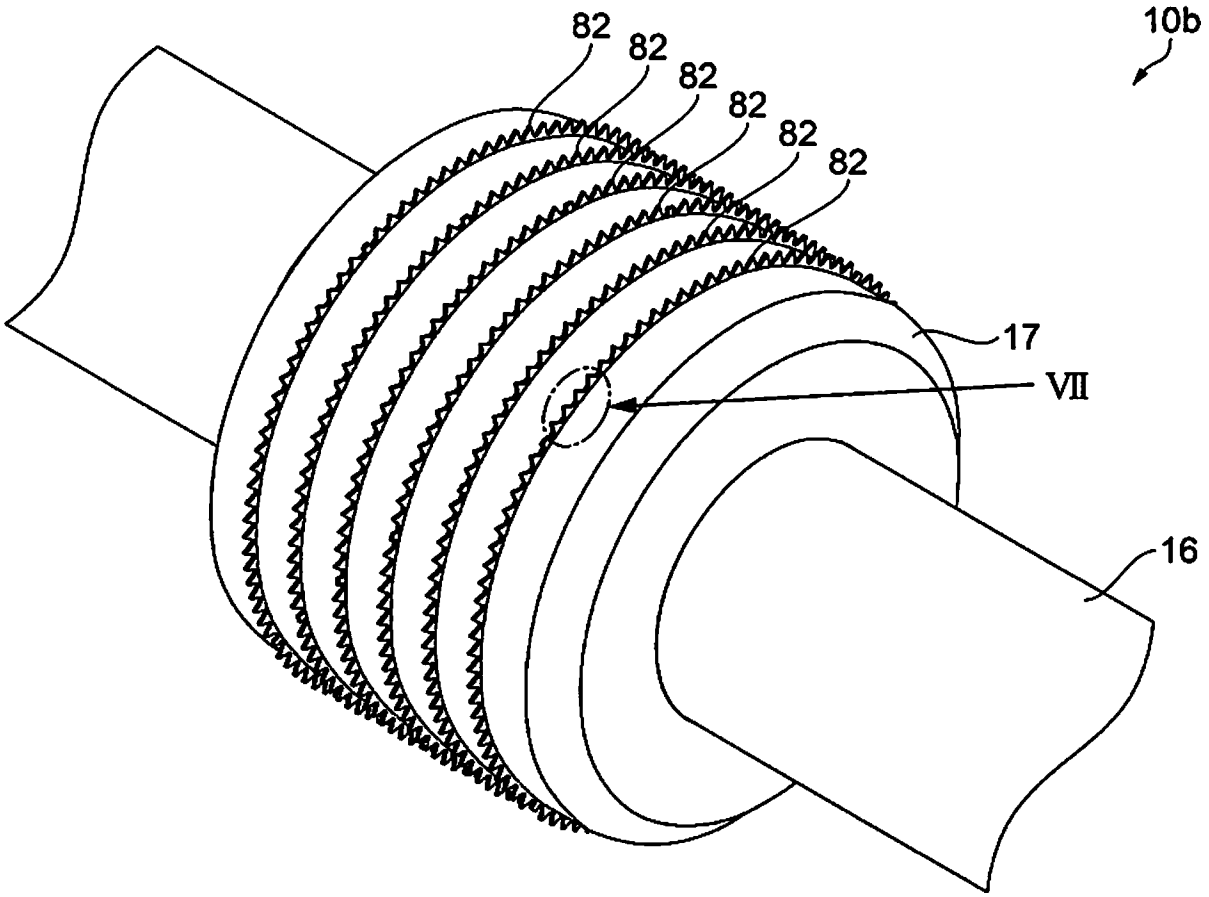
FIG. 6 is a partial schematic view illustrating the overview of a driven roller.
Figure 7:
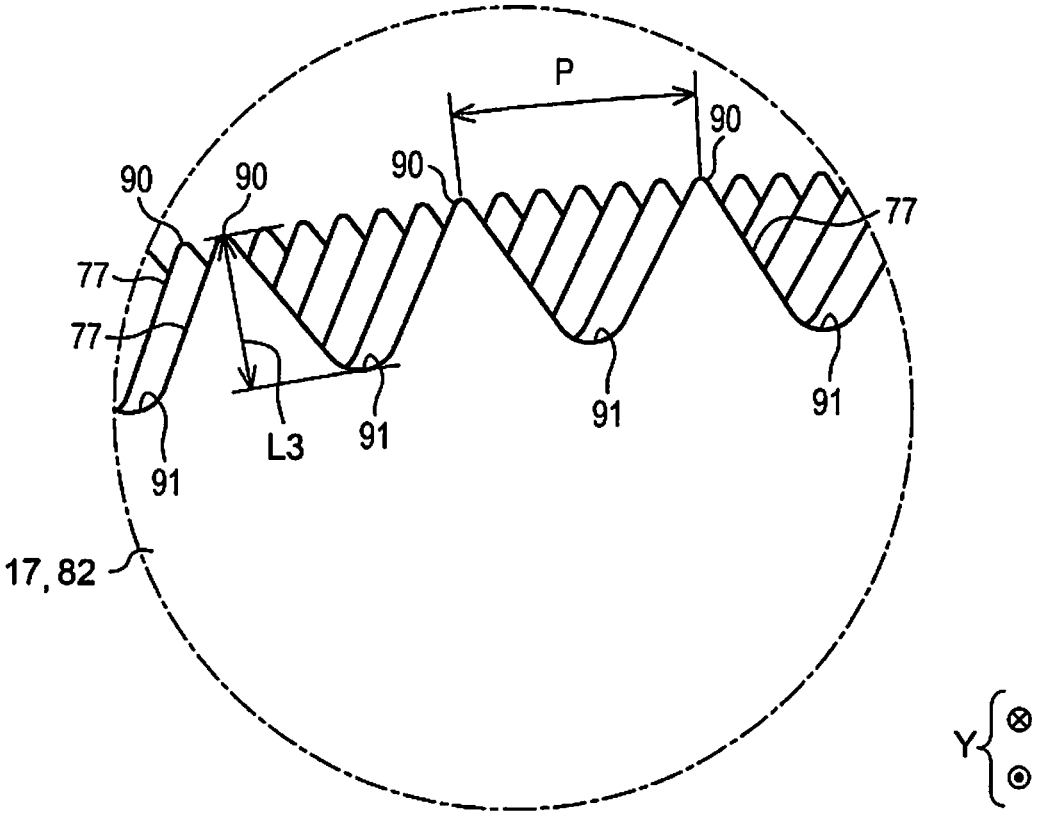
FIG. 7 is a partial enlarged view illustrating a region VII in FIG. 6.
Figure 8:
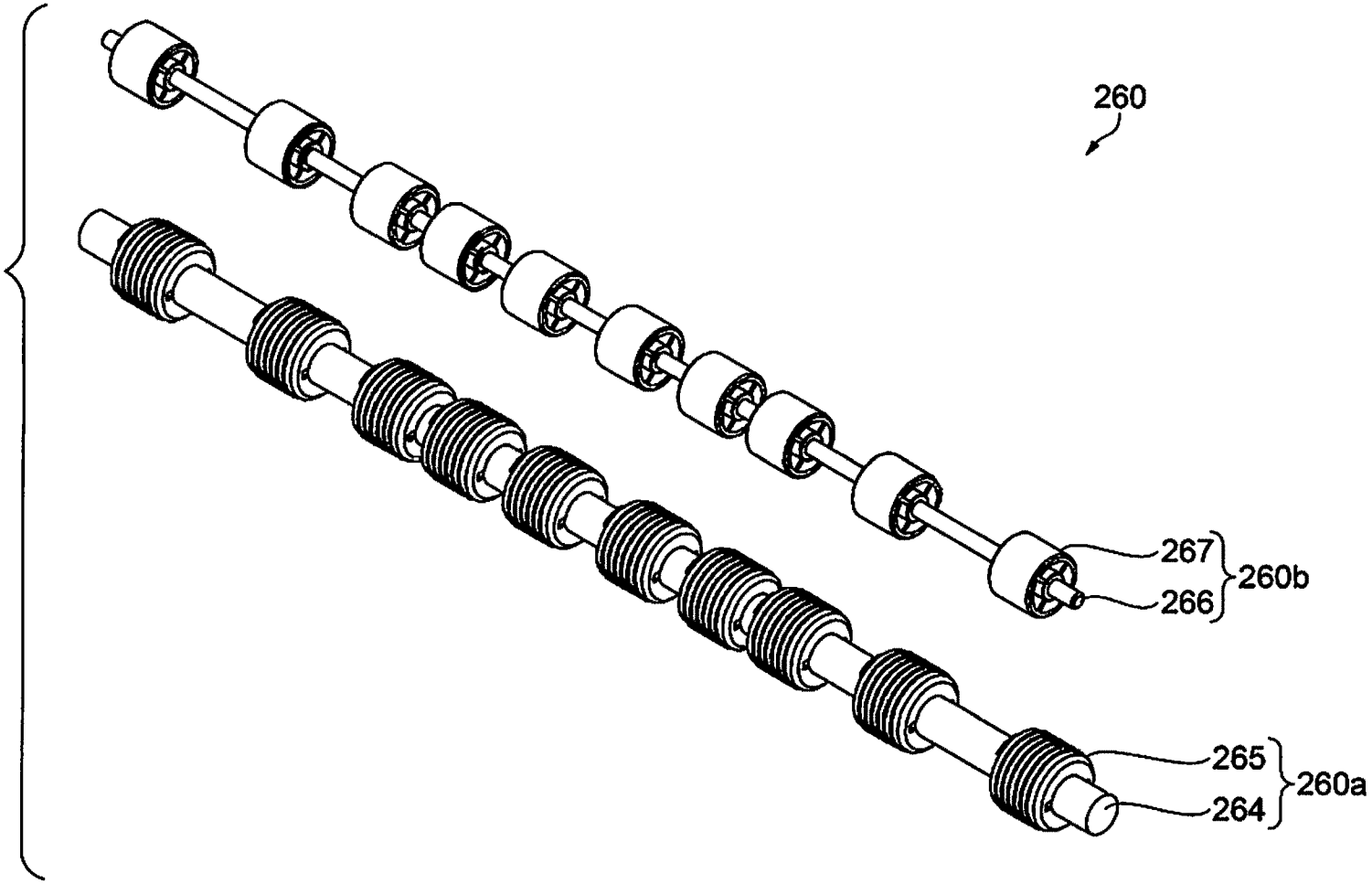
FIG. 8 is a schematic view illustrating the overview of a pair of correction rollers.

FIG. 3 is a view corresponding to a schematic view of the intermediate unit illustrated in FIG. 1 and is a schematic view illustrating a state of a transportation system in the intermediate unit. FIG. 4 is a schematic view illustrating the overview of a driving roller. FIG. 5 is a partial enlarged view of the driving roller. FIG. 6 is a partial schematic view illustrating the overview of a driven roller. FIG. 7 is a partial enlarged view illustrating a region VII surrounded by a dashed line in FIG. 6. FIG. 8 is a schematic view illustrating the overview of a pair of correction rollers.

Note that, in FIGS. 3 to 8, components which are not necessary for description are not illustrated. In addition, in FIG. 3, driving rollers 10*a*, 20*a*, 30*a*, 40*a*, 50*a*, 260*a*, and 270*a*, which are driven by a motor, are illustrated with large circles and driven rollers 10*b*, 20*b*, 30*b*, 40*b*, 50*b*, 260*b*, and 270*b*, which are rotated in accordance with the rotation of the driving rollers, are illustrated with small circles.

Next, the overview of the intermediate unit 200 will be described with reference to FIGS. 3 to 8.

As illustrated in FIG. 3, the transportation path 201 includes a branch point A, a branch point B, and a branch point C at which a transportation path of the paper sheet M branches, a junction point D at which the transportation paths of the paper sheet M join each other, and an end E and an end F which are terminals of the transportation path of the paper sheet M. In addition, each of the branch point A, the branch point B, and the branch point C is provided with a guide flap (not shown) which distributes the transportation path of the paper sheet M.

Furthermore, the transportation path 201 is configured of an inlet path 202, a first branch path 203, a first switching back path 204, a first junction path 205, a second branch path 206, a second switching back path 207, a second junction path 208, and an outlet path 209.

The transportation path 201 between the carry-in port 292 and the branch point A is the inlet path 202. The transportation path 201 between the branch point A and the branch point B is the first branch path 203. The transportation path 201 between the branch point B and the end E is the first switching back path 204. The transportation path 201 between the branch point B and the junction point D is the first junction path 205. The transportation path 201 between the branch point A and the branch point C is the second branch path 206. The transportation path 201 between the branch point C and the end F is the second switching back path 207. The transportation path 201 between the branch point C and the junction point D is the second junction path 208. The transportation path 201 between the junction point D and the carry-out port 293 is the outlet path 209.

The group of pairs of fifth transportation rollers 250 is provided in the inlet path 202, the first branch path 203, and the second branch path 206 and the group of pairs of fifth transportation rollers 250 controls transportation of the paper sheet M. The group of pairs of third transportation rollers 230 is provided in the first switching back path 204, and the group of pairs of third transportation rollers 230 controls transportation of the paper sheet M. The group of pairs of fourth transportation rollers 240 is provided in the second switching back path 207, and the group of pairs of fourth transportation rollers 240 controls transportation of the paper sheet M. The group of pairs of second transportation rollers 220 is provided in the first junction path 205, the second junction path 208, and the upstream side in the outlet path 209 in the transportation direction of the paper sheet M and the group of pairs of second transportation rollers 220 controls transportation of the paper sheet M. The group of pairs of first transportation rollers 210, the pair of correction rollers 260, and the pair of discharging rollers 270 are provided on the downstream side in the outlet path 209 in the transportation direction of the paper sheet M and the group of pairs of first transportation rollers 210, the pair of correction rollers 260, and the pair of discharging rollers 270 control transportation of the paper sheet M.

As will be described in detail later, in a case where the skew of the paper sheet M with respect to the transportation direction occurs in the transportation path 201, the pair of correction rollers 260 corrects the skew of the paper sheet M. In addition, the paper sheet M of which the skew is corrected is nipped by the pair of correction rollers 260 and is fed (transported) to the carry-out port 293.

The pair of correction rollers 260 is positioned on the downstream side of the group of pairs of first transportation rollers 210 in the transportation direction and is disposed such that the leading end T (refer to FIG. 11) of the paper sheet M reaches the carry-out port 293 while the paper sheet M is transported by being nipped by the pair of correction rollers 260. Since the length of the paper sheet M in the transportation direction is significantly smaller than the length of the transportation path 201, a state where the pair of correction rollers 260 is disposed such that the leading end T of the paper sheet M reaches the carry-out port 293 while the paper sheet M is transported by being nipped by the pair of correction rollers 260 corresponds to a state where the pair of correction rollers 260 is disposed close to the carry-out port 293.

That is, the pair of correction rollers 260 is positioned on the downstream side of the group of pairs of first transportation rollers 210 in the transportation direction and is disposed close to the carry-out port 293.

In the present embodiment, the pair of correction rollers 260 is disposed such that the leading end T of any type of paper sheet M reaches the carry-out port 293 while the paper sheet M is transported by being nipped by the pair of correction rollers 260 in a case where there are various kinds of paper sheets M which are different in length in the transportation direction. That is, the pair of correction rollers 260 is disposed such that the leading end T of the paper sheet M which is shortest in the transportation direction also reaches the carry-out port 293 while the paper sheet M is transported by being nipped by the pair of correction rollers 260 in a case where there are various kinds of paper sheets M which are different in length in the transportation direction.

The group of pairs of third transportation rollers 230 and the group of pairs of fourth transportation rollers 240 can be rotated forwards and backwards and can reverse the transportation direction of the paper sheet M in the first switching back path 204 and the second switching back path 207.

The pair of first transportation rollers 10 disposed in the group of pairs of first transportation rollers 210 is configured of the first driving roller 10*a* and the first driven roller 10*b*. The pair of second transportation rollers 20 disposed in the group of pairs of second transportation rollers 220 is configured of the second driving roller 20*a* and the second driven roller 20*b*. The pair of third transportation rollers 30 disposed in the group of pairs of third transportation rollers 230 is configured of the third driving roller 30*a* and the third driven roller 30*b*. The pair of fourth transportation rollers 40 disposed in the group of pairs of fourth transportation rollers 240 is configured of the fourth driving roller 40*a* and the fourth driven roller 40*b*. The pair of fifth transportation rollers 50 disposed in the group of pairs of fifth transportation rollers 250 is configured of the fifth driving roller 50*a* and the fifth driven roller 50*b*.

The pair of discharging rollers 270 is configured of the driving roller 270*a* and the driven roller 270*b*.

Note that, the first driving roller 10*a*, the second driving roller 20*a*, the third driving roller 30*a*, the fourth driving roller 40*a*, the fifth driving roller 50*a*, and the driving roller 270*a* have the same configuration. Therefore, the description thereof will be made by using the first driving roller 10*a* as a representative and description of the driving rollers 20*a*, 30*a*, 40*a*, 50*a*, and 270*a* will be omitted.

The first driven roller 10*b*, the second driven roller 20*b*, the third driven roller 30*b*, the fourth driven roller 40*b*, the fifth driven roller 50*b*, and the driven roller 270*b* have the same configuration. Therefore, the description thereof will be made by using the first driven roller 10*b* as a representative and description of the driven rollers 20*b*, 30*b*, 40*b*, 50*b*, and 270*b* will be omitted.

Furthermore, in the following description, there is a case where the driving rollers 20*a*, 30*a*, 40*a*, and 50*a* are collectively referred to as a driving roller 1 and the driven rollers 20*b*, 30*b*, 40*b*, and 50*b* are collectively referred to as a driven roller 2.

In the pair of first transportation rollers 10, when a motor, which is a power source of the pair of first transportation rollers 10, is driven with the first driving roller 10*a* and the first driven roller 10*b* nipping (interposing) the paper sheet M, the first driving roller 10*a* is rotated and a force (transportation force) transporting the paper sheet M in the transportation direction is applied to the paper sheet M. The first driven roller 10*b* is rotated in accordance with the rotation of the first driving roller 10*a* with the paper sheet M nipped between the first driving roller 10*a* and the first driven roller 10*b*.

In a case where an image is printed on one surface of the paper sheet M in the printing unit 100, the first driven roller 10*b* comes into contact with the one surface on which the image is formed and the first driving roller 10*a* comes into a surface on which no image is formed. In a case where images are printed on both surfaces of the paper sheet M in the printing unit 100, the first driven roller 10*b* comes into contact with a surface on which the image is formed later and the first driving roller 10*a* comes into a surface on which the image is formed earlier.

In the following description, one surface of the paper sheet M, on which an image is formed in a case where an image is printed on one surface of the paper sheet M, and a surface, on which an image is formed later in a case where images are printed on both surfaces of the paper sheet M, are referred to as a front surface of the paper sheet M. A surface of the paper sheet M, on which no image is formed in a case where an image is formed on one surface of the paper sheet M, and a surface, on which an image is formed earlier in a case where images are printed on both surfaces of the paper sheet M, are referred to as a rear surface of the paper sheet M.

That is, the first driven roller 10*b* comes into contact with the front surface of the paper sheet M and the first driving roller 10*a* comes into contact with the rear surface of the paper sheet M.

The length of the first driving roller 10*a* is greater than the maximum assumed width of the paper sheet M and the first driving roller 10*a* comes into contact with the rear surface of the paper sheet M over the entire region in the width direction of the paper sheet M. As illustrated in FIGS. 4 and 5, the first driving roller 10*a* has a cylindrical shape extending in one direction and includes a driving shaft 11, a rubber roller portion 12 which is inserted on the driving shaft 11, and a rough surface portion 13 that covers the rubber roller portion 12. The rough surface portion 13 comes into contact with the rear surface of the paper sheet M. The rubber roller portion 12 is fixed to the driving shaft 11 and is provided to be capable of integrally rotating with the driving shaft 11. The rough surface portion 13 is configured of a binding agent layer 14 that covers the rubber roller portion 12 and ceramic particles 15 that are embedded such that the ceramic particles 15 protrude from a surface of the binding agent layer 14.

Since the ceramic particles 15 are disposed to bite into the rear surface of the paper sheet M with the rough surface portion 13 being provided on the outer circumferential surface of the first driving roller 10*a* which comes into contact with the paper sheet M, a force in the transportation direction is stably applied to the paper sheet M and the paper sheet M is transported stably. That is, since the ceramic particles 15 bite into the rear surface of the paper sheet M, the first driving roller 10*a* is not likely to slide on the paper sheet M and a force in the transportation direction from the first driving roller 10*a* is stably applied to the paper sheet M. Therefore, the paper sheet M is transported stably.

Furthermore, since the ceramic particles 15 come into point contact with the rear surface of the paper sheet M, the contact area between the first driving roller 10*a* and the paper sheet M is small. Therefore, for example, in a case where duplex printing is performed on the paper sheet M and undried ink remains on the rear surface of the paper sheet M, the undried ink is not likely to be transferred to the first driving roller 10*a* and the first driving roller 10*a* is not likely to be contaminated.

The first driven roller 10*b* is divided into a plurality of roller bodies (roller portion 17). Therefore, the area of a portion of the first driven roller 10*b* which comes into contact with the paper sheet M is smaller than the area of a portion of the first driving roller 10*a* which comes into contact with the paper sheet M.

In FIG. 6, one of the plurality of roller bodies (roller portion 17) of the first driven roller 10*b* is illustrated. As illustrated in FIG. 6, the first driven roller 10*b* is configured to include a driven shaft 16 and the roller portion 17 that is inserted onto the driven shaft 16. Specifically, the first driven roller 10*b* is configured to include the driven shaft 16 and the plurality of roller portions 17 that are inserted onto the driven shaft 16. Each roller portion 17 is fixed to the driven shaft 16 and is provided to be capable or integrally rotating with the driven shaft 16. Each roller portion 17 includes six toothed plates 82.

FIG. 7 is a partial enlarged view illustrating the region VII as seen from a direction (direction Y) along the driven shaft 16 and illustrates teeth 77 provided on a circumferential surface of the roller portion 17 (six toothed plates 82).

As illustrated in FIG. 7, the teeth 77 are provided on the circumferential surface of the roller portion 17 (six toothed plates 82) such that the positions of the teeth 77 are misaligned and the teeth 77 do not completely overlap each other when seen in the direction Y. That is, the teeth 77 are disposed on the circumferential surface of the roller portion 17 such that all of the teeth 77 can be visually recognized when seen in the direction Y.

Specifically, the teeth 77 are disposed such that the sizes of gaps between a tooth 77 and a tooth 77 in the circumferential direction of the roller portion 17 become equal when seen in the direction Y. That is, the teeth 77 of five toothed plates 82 are disposed so that a pitch P between a tooth 77 and a tooth 77 of one toothed plate 82 is divided into six equal parts. Note that, in the present embodiment, the length of the pitch P between a tooth 77 and a tooth 77 is approximately 0.6 mm.

In addition, the tip ends of the teeth 77 provided on the circumferential surfaces of the six toothed plates 82 come into point contact with the paper sheet M. That is, the first driven roller 10*b* (roller portion 17) includes the teeth 77 protruding outward from the surface thereof and the teeth 77 come into point contact with the front surface of the paper sheet M.

Note that, each of the teeth 77 provided on the first driven roller 10*b* is an example of "a convex portion that can come into point contact". That is, the first driven roller 10*b* includes a surface, on which the convex portions (teeth 77) that can come into point contact with the paper sheet M are provided, and comes into contact with the front surface of the paper sheet M.

In addition, when each of the tip ends of the teeth 77 of the toothed plates 82 is called a mountain portion 90, a groove-shaped valley portion 91 is provided between a mountain portion 90 and a mountain portion 90. In the present embodiment, a distance L3 between the valley portion 91 of the tooth 77 and the mountain portion 90 in the radial direction of the roller portion 17 is approximately 0.41 mm. In addition, the shape of the tooth 77 which comes into point contact with the paper sheet M is preferably a triangular shape of which the point angle is equal to or greater than 45 degrees. In the present embodiment, the tooth 77 is configured such that an angle thereof at the mountain portion 90 is 60 degrees.

As described above, each tooth 77 has a shape protruding outward from the surface of the first driven roller 10*b* and the contact area with respect to the paper sheet M can be smaller than that of the ceramic particles 15. In a case where duplex printing is performed on the paper sheet M, undried ink is more likely to remain on the front surface of the paper sheet M than on the rear surface of the paper sheet M. Even in a case where there is a large amount of undried ink on the front surface of the paper sheet M, since the contact area with respect to the paper sheet M of the first driven roller 10*b* is smaller than that of the first driving roller 10*a*, the undried ink is not likely to be transferred to the first driven roller 10*b* and the first driven roller 10*b* is not likely to be contaminated.

Furthermore, since the teeth 77 protruding outward from the surface of the first driven roller 10*b* bite into the front surface of the paper sheet M, the first driven roller 10*b* is not likely to slide on the paper sheet M and can be stably rotated in accordance with rotation of the first driving roller 10*a* with the paper sheet M nipped between the first driving roller 10*a* and the first driven roller 10*b*.

As illustrated in FIG. 8, the pair of correction rollers 260 is configured of the driving roller 260*a* and the driven roller 260*b*. When a motor is a power source is driven, the driving roller 260*a* is rotated. The driven roller 260*b* is rotated in accordance with the rotation of the driving roller 260*a* with the paper sheet M nipped between the driving roller 260*a* and the driven roller 260*b*. That is, the pair of correction rollers 260 includes the driving roller 260*a* which is rotated in a direction in which the paper sheet M is transported toward the carry-out port 293 and the driven roller 260*b* which is rotated in accordance with the rotation of the driving roller 260*a* with the paper sheet M nipped between the driving roller 260*a* and the driven roller 260*b*.

Note that, the driving roller 260*a* is an example of a "first roller" and the driven roller 260*b* is an example of a "second roller".

The driving roller 260*a* comes into contact with the front surface of the paper sheet M and the driven roller 260*b* comes into contact with the rear surface of the paper sheet M. That is, the driven rollers 20*b*, 30*b*, 40*b*, 50*b*, and 270*b* and the driving roller 260*a* come into contact with the front surface of the paper sheet M and the driving rollers 20*a*, 30*a*, 40*a*, 50*a*, and 270*a* and the driven roller 260*b* come into contact with the rear surface of the paper sheet M.

Note that, a configuration in which the driven roller 260*b* comes into contact with the front surface of the paper sheet M and the driving roller 260*a* comes into contact with the rear surface of the paper sheet M may also be adopted. That is, a configuration in which the driven rollers 20*b*, 30*b*, 40*b*, 50*b*, and 270*b* and the driven roller 260*b* come into contact with the front surface of the paper sheet M and the driving rollers 20*a*, 30*a*, 40*a*, 50*a*, and 270*a* and the driving roller

260*a* come into contact with the rear surface of the paper sheet M may also be adopted.

The driving roller 260*a* is configured to include a driving shaft 264 and a plurality of rollers 265 which are inserted onto the driving shaft 264. Each roller 265 is fixed to the driving shaft 264 and is provided to be capable or integrally rotating with the driving shaft 264. The roller 265 has the same configuration as the roller portion 17 (refer to FIG. 6) of the first driven roller 10*b* in the pair of first transportation rollers 10. That is, a surface of the roller 265 is provided with teeth 77 (refer to FIG. 7) protruding outward from the surface and the teeth 77 come into point contact with the front surface of the paper sheet M.

As described above, the driving roller 260*a* includes the surface on which the teeth 77 that can come into point contact with the paper sheet M are provided. In addition, the teeth 77 are provided on the circumferential surface of the driving roller 260*a* (roller portion 17) such that the positions of the teeth 77 are misaligned and the teeth 77 do not completely overlap each other when seen in the direction Y (refer to FIG. 7).

Note that, each of the teeth 77 provided on the driving roller 260*a* is an example of "a convex portion that can come into point contact". That is, the driving roller 260*a* includes a surface, on which the convex portions (teeth 77) that can come into point contact with the paper sheet M are provided.

As a result, since the teeth 77 provided on the surface of the driving roller 260*a* bite into the front surface of the paper sheet M, the driving roller 260*a* is not likely to slide on the paper sheet M and a force in the transportation direction can be stably applied to the paper sheet M. Therefore, the paper sheet M can be transported stably. Since the driving roller 260*a* is provided with the teeth 77 on the surface thereof, the driving roller 260*a* is not likely to be contaminated.

The driven roller 260*b* is configured to include a driven shaft 266 and a plurality of rollers 267 which are inserted onto the driven shaft 266. Each roller 267 is rotatably supported by the driven shaft 266 and is disposed so as to face each roller 265 of the driving roller 260*a*. Each of the plurality of rollers 267 includes a flat surface with no uneven portion. Accordingly, the paper sheet M is likely to slide on the driven roller 260*b* in comparison with the driving roller 260*a* that includes the teeth 77 on the surface thereof.

That is, the driven roller 260*b* includes a flat surface on which the paper sheet M is likely to slide.

Furthermore, the driven roller 260*b* is configured with a material which is excellent in wear resistance and has a high slidability. For example, the driven roller 260*b* is configured with polyacetal (acetal resin) and has a self-lubricating property and a high slidability in addition to the wear resistance. In addition to polyacetal, polyamide, polytetrafluoroethylene (fluororesin), polyphenylene sulfide, and the like can be used as the constituent material of the driven roller 260*b*.

The driven roller 260*b* comes into surface contact with the rear surface of the paper sheet M.

The paper sheet M transported into the intermediate unit 200 reaches the pair of correction rollers 260 via the group of pairs of fifth transportation rollers 250, the group of pairs of fourth transportation rollers 240, the group of pairs of third transportation rollers 230, the group of pairs of second transportation rollers 220, and the group of pairs of first transportation rollers 210. While the paper sheet M is transported via the group of pairs of fifth transportation rollers 250, the group of pairs of fourth transportation rollers 240, the group of pairs of third transportation rollers 230, the group of pairs of second transportation rollers 220, and the group of pairs of first transportation rollers 210, ink adhering to the rear surface of the paper sheet M is gradually dried. Therefore, undried ink is not likely to remain on the rear surface of the paper sheet M that comes into contact with the driven roller 260*b*. Therefore, even in a case where the driven roller 260*b* comes into surface contact with the rear surface of the paper sheet M, the driven roller 260*b* is not likely to be contaminated with undried ink.

Transportation Path of Intermediate Unit

Figure 9:
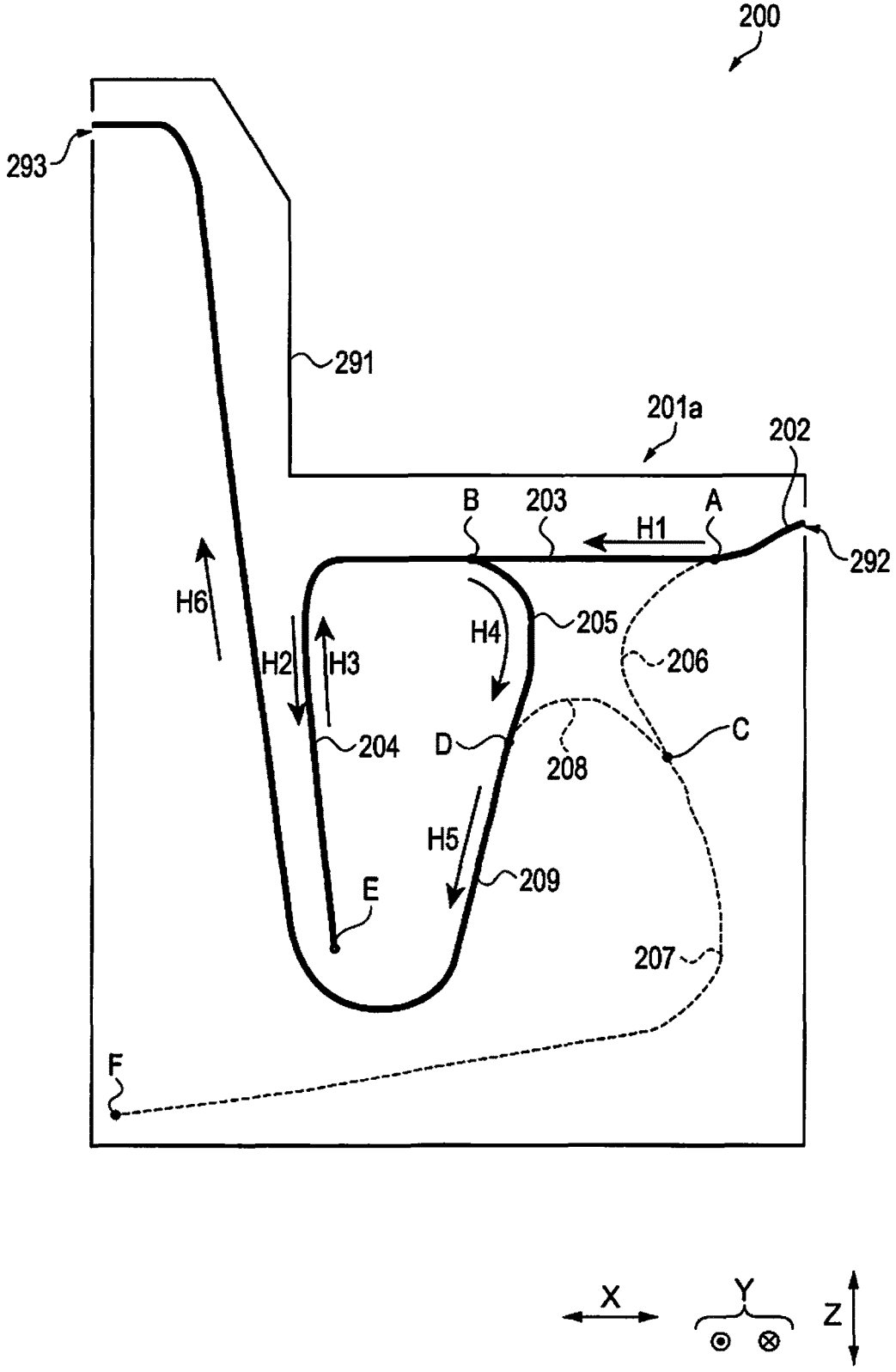
FIG. 9 is a schematic view illustrating a transportation path of a paper sheet.
Figure 10:
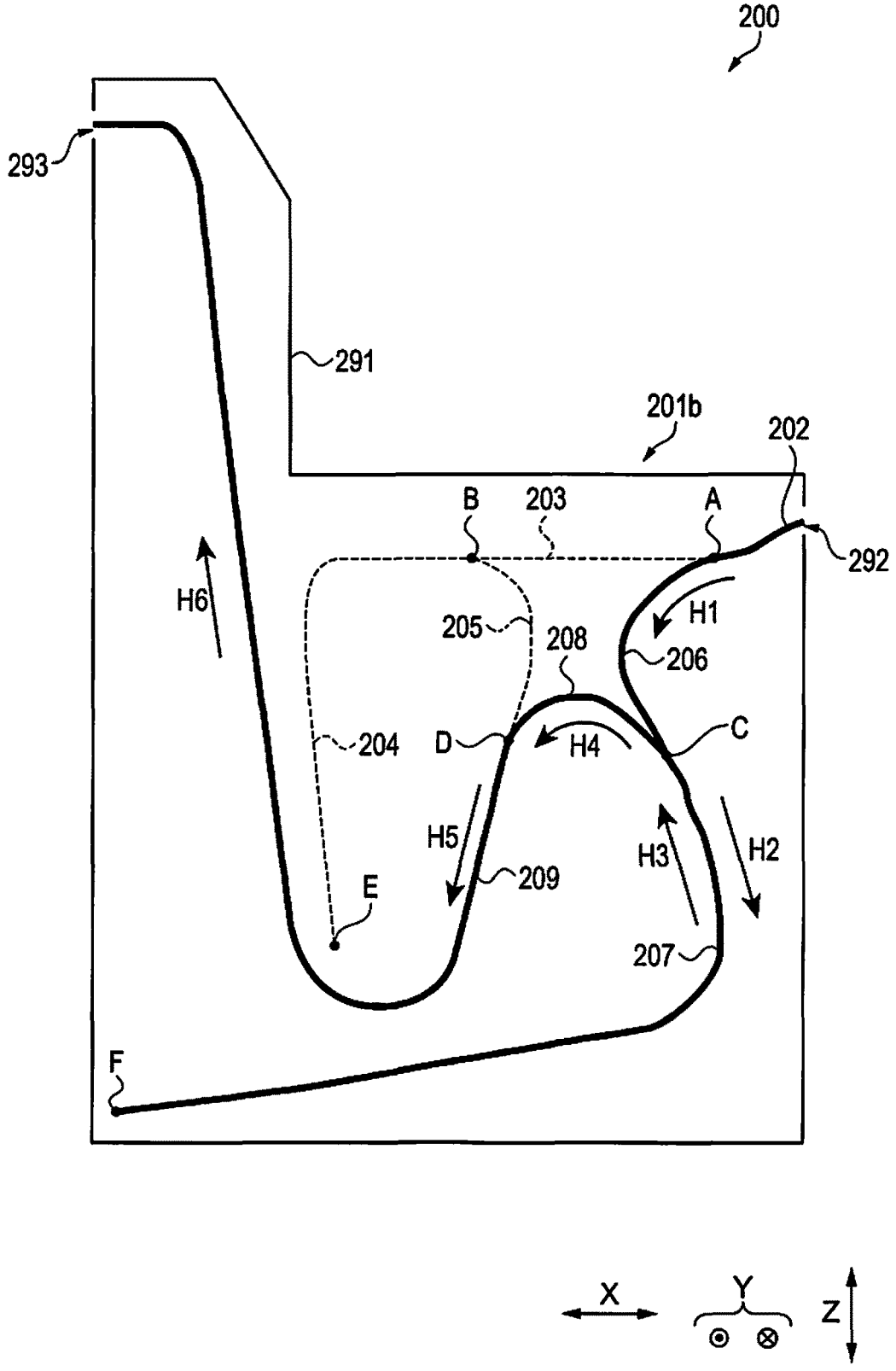
FIG. 10 is a schematic view illustrating a transportation path of another paper sheet.

FIG. 9 is a schematic view illustrating a transportation path of the paper sheet. FIG. 10 is a schematic view illustrating a transportation path of another paper sheet.

Note that, FIGS. 9 and 10 are views corresponding to FIG. 3 and components such as the driving rollers 20*a*, 30*a*, 40*a*, 50*a*, 260*a*, and 270*a* and the driven rollers 20*b*, 30*b*, 40*b*, 50*b*, 260*b*, and 270*b* which are not necessary for describing the transportation path are not illustrated. Furthermore, in FIGS. 9 and 10, a portion of the transportation path 201 which is used for transportation of the paper sheet M is illustrated with a solid line and a portion of the transportation path 201 which is not used for the transportation of the paper sheet M is illustrated with a broken line.

In addition, each of arrows in FIGS. 9 and 10 denotes the transportation direction of the paper sheet M and the arrows are given reference symbols H1 to H6.

As illustrated with the solid line in FIG. 9, a first transportation path 201*a* along which the paper sheet M is transported is configured of the inlet path 202, the first branch path 203, the first switching back path 204, the first junction path 205, and the outlet path 209.

In the first transportation path 201*a*, the paper sheet M, which is transported into the intermediate unit through the carry-in port 292, passes through the inlet path 202, advances in a transportation direction H1 in the first branch path 203, and is transported into the first switching back path 204. The paper sheet M which is transported into the first switching back path 204 advances in a transportation direction H2. Thereafter, the advancing direction of the paper sheet M is reversed (switched back) and thus the paper sheet M advances in a transportation direction H3 which is opposite to the transportation direction H2 and is transported into the first junction path 205. Furthermore, the paper sheet M advances in a transportation direction H4 in the first junction path 205, is transported into the outlet path 209, advances in a transportation direction H5 and a transportation direction H6 in the outlet path 209, and is transported to the post processing unit 300 through the carry-out port 293.

As illustrated with the solid line in FIG. 10, another transportation path 201*b* (second transportation path 201*b*) along which the paper sheet M is transported is configured of the inlet path 202, the second branch path 206, the second switching back path 207, the second junction path 208, and the outlet path 209.

In the second transportation path 201*b*, the paper sheet M, which is transported into the intermediate unit through the carry-in port 292, passes through the inlet path 202, advances in a transportation direction H1 in the second branch path 206, and is transported into the second switching back path 207. The paper sheet M which is transported into the second switching back path 207 advances in a transportation direction H2. Thereafter, the advancing direction of the paper sheet M is reversed (switched back) and thus the paper sheet M advances in a transportation direction H3 which is opposite to the transportation direction H2 and is transported into the second junction path 208. Furthermore, the paper sheet M advances in a transportation direction H4 in the second junction path 208, is transported into the outlet path 209, advances in the transportation direction H5 and the transportation direction H6 in the outlet path 209, and is transported to the post processing unit 300 through the carry-out port 293.

The paper sheet M which is transported into the intermediate unit through the carry-in port 292 is guided toward the first transportation path 201*a* by a guide flap provided at the branch point A. Thereafter, the next paper sheet M which is transported into the intermediate unit through the carry-in port 292 is guided toward the second transportation path 201*b* by the guide flap provided at the branch point A.

In addition, transportation of the paper sheet M along the first transportation path 201*a* and transportation of the paper sheet M along the second transportation path 201*b* are alternately repeated.

Since the intermediate unit 200 includes the two transportation paths (first transportation path 201*a* and second transportation path 201*b*), the transportation ability for the paper sheet M can be improved in comparison with a case where the intermediate unit 200 includes one transportation path.

Since the transportation paths 201*a* and 201*b* include the switching back paths 204 and 207, the transportation paths 201*a* and 201*b* can be lengthened in comparison with a case where the transportation paths 201*a* and 201*b* do not include the switching back paths 204 and 207. That is, the intermediate unit 200 according to the present embodiment is configured such that it is possible to achieve space saving, improve the transportation ability for the paper sheet M, and lengthen the transportation paths 201*a* and 201*b*.

In printing unit 100, ink (aqueous ink) is ejected from the printing head 111 to the paper sheet M and the ink adheres to the paper sheet M, moisture in the ink penetrates into the paper sheet M and the paper sheet M absorbs the moisture. In the intermediate unit 200, the moisture absorbed by the paper sheet M is evaporated with the paper sheet M being transported along the transportation paths 201*a* and 201*b* so that ink adhering to the paper sheet M is dried. Since the transportation paths 201*a* and 201*b* are long, it is possible to more appropriately dry the ink adhering to the paper sheet M than in a case where the transportation paths 201*a* and 201*b* are short.

As described above, in the intermediate unit 200, since the paper sheet M is transported along the transportation paths 201*a* and 201*b*, which are long because of the switching back paths 204 and 207, it is possible to appropriately dry the ink adhering to the paper sheet M. In other words, the transportation paths 201*a* and 201*b* function as drying paths in which the moisture absorbed by the paper sheet M is dried so that the ink adhering to the paper sheet M is appropriately dried.

When the transportation direction (advancing direction) of the paper sheet M is switched back in the switching back paths 204 and 207 and the advancing direction of the paper sheet M is reversed, the position of the front surface of the paper sheet M with respect to the transportation direction is also reversed. That is, after the advancing direction of the paper sheet M is switched back in the switching back paths 204 and 207, the position of the front surface of the paper sheet M with respect to the transportation direction is reversed.

Therefore, the position of the front surface of the paper sheet M, which is transported into the intermediate unit through the carry-in port 292, with respect to the transportation direction is reversed in the switching back paths 204 and 207. In addition, the paper sheet M is transported to the post processing unit 300 through the carry-out port 293 in a state of the position of the front surface with respect to the transportation direction is reversed.

As a result, the paper sheet M is transported into the intermediate unit through the carry-in port 292 in a state where the front surface is disposed on the upper side in the vertical direction Z and the paper sheet M is transported out of the intermediate unit through the carry-out port 293 in a state where the front surface is disposed on the lower side in the vertical direction Z. That is, in the printing apparatus 1000, the paper sheet M is transported into the intermediate unit 200 from the printing unit 100 in a state where the front surface is disposed on the upper side in the vertical direction Z and the paper sheet M is transported into the post processing unit 300 from the intermediate unit 200 in a state where the front surface is disposed on the lower side in the vertical direction Z.

Meanwhile, when the aqueous ink is ejected from the printing head 111 to the paper sheet M in the printing unit 100 and the paper sheet M absorbs moisture, the paper sheet M swells. Furthermore, the printing duty of the paper sheet M is not uniform and the paper sheet M includes a portion with a high printing duty on which a dense image is formed (a portion onto which a large amount of ink ejected) and a portion with a low printing duty on which a light image is formed (a portion onto which a small amount of ink ejected). At the portion with the high printing duty, since the paper sheet M absorbs a large amount of moisture, the paper sheet M significantly swells. At the portion with the low printing duty, since the paper sheet M absorbs a small amount of moisture, the paper sheet M slightly swells.

Therefore, in the paper sheet M on which an image has been printed, a portion that significantly swells and a portion that slightly swells are mixed together and the paper sheet M curls (is curved) due to the difference in swelling state.

Accordingly, in the intermediate unit 200, the paper sheet M which has absorbed moisture and has curled is transported along the transportation paths 201*a* and 201*b*. Furthermore, the curling state of the paper sheet M is changed depending on an image pattern to be printed or an ink composition (moisture content) and thus the paper sheet M which has curled in various ways is transported along the transportation paths 201*a* and 201*b*.

In a case where the paper sheet M does not curl, an end portion of the paper sheet M which is disposed on the downstream side in the transportation direction (hereinafter, referred to as leading end T (refer to FIG. 11)) is likely to come into contact with the driving roller 1 or the driven roller 2 in a uniform manner and thus the skew of the paper sheet M with respect to the transportation direction is not likely to occur.

However, in a case where the paper sheet M curls, it is difficult for the leading end T of the paper sheet M to come into contact with the driving roller 1 or the driven roller 2 in a uniform manner and the skew of the paper sheet M with respect to the transportation direction is likely to occur. Furthermore, the state of the skew of the paper sheet M changes depending on the state of curling of the paper sheet M and thus the skew of the paper sheet M may be slight or the skew of the paper sheet M may be significant.

Therefore, the paper sheet M of which the skew with respect to the transportation direction is slight or the paper sheet M of which the skew with respect to the transportation direction is significant is transported into the post processing unit 300 from the intermediate unit 200.

In a case where the skew of the paper sheet M is significant, the paper sheet M is mounted on the stacker 328 in a state of being skew and thus it is difficult for the post processing portion 325 to appropriately perform the post processing on the paper sheet M mounted on the stacker 328.

Therefore, the intermediate unit 200 according to the present embodiment includes a mechanism for correcting the skew of the paper sheet M with respect to the transportation direction in the vicinity of the carry-out port 293 through which the paper sheet M is transported to the post processing unit 300. In the intermediate unit 200, the skew of the paper sheet M with respect to the transportation direction, which occurs when the paper sheet M is transported along the transportation paths 201*a* and 201*b*, is appropriately corrected in the vicinity of the carry-out port 293. Therefore, the paper sheets M are mounted on the stacker 328 in a state of being aligned and thus it is possible for the post processing portion 325 to appropriately perform the post processing on the paper sheets M mounted on the stacker 328.

Figure 11:
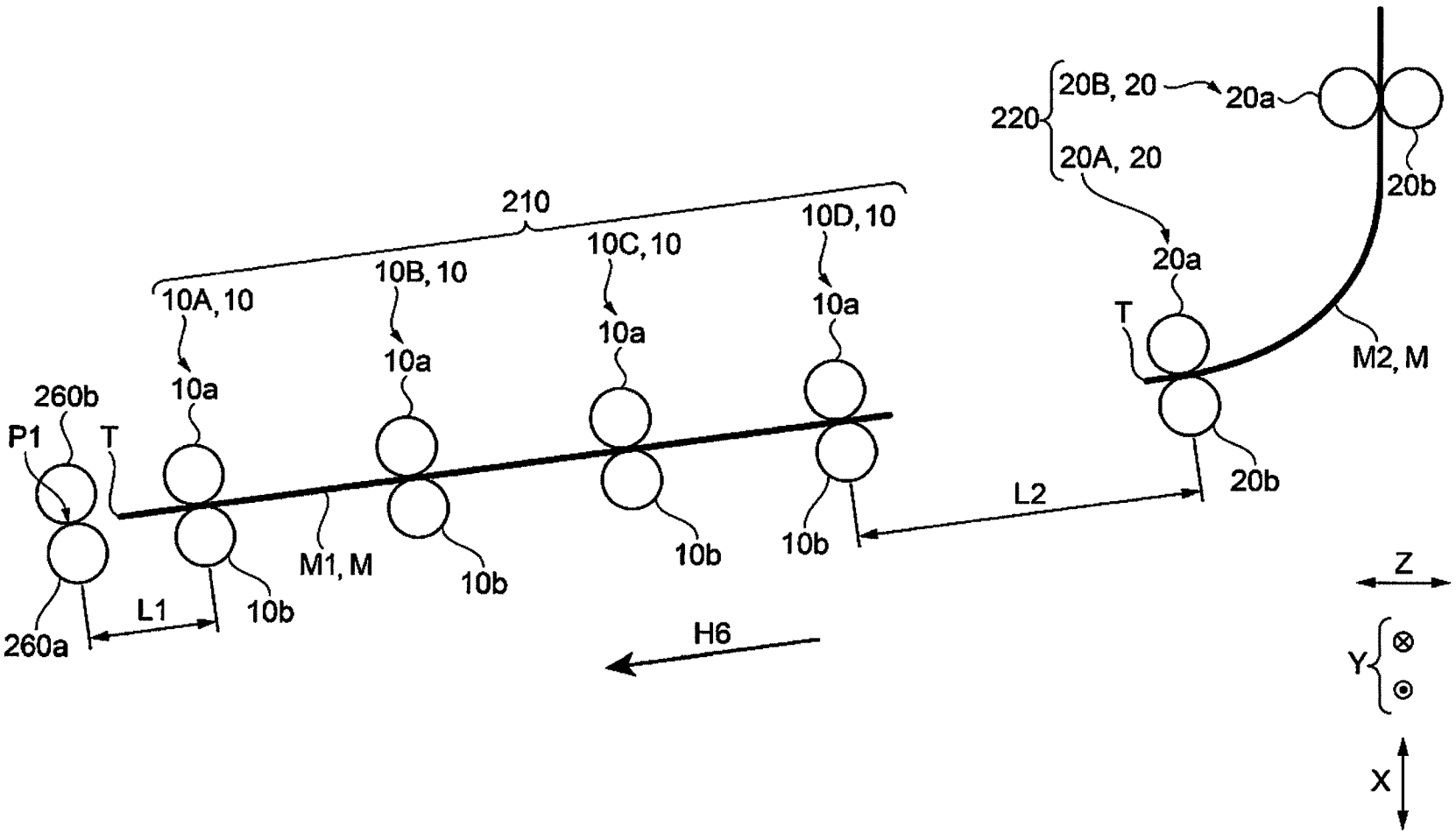
FIG. 11 is a schematic view illustrating a state before skew of the paper sheet is corrected.

Hereinafter, details thereof will be described. Method of Correcting Skew of Paper Sheet FIG. 11 is an enlarged view illustrating a portion of FIG. 3 in which the pair of correction rollers is disposed and is a schematic view illustrating a state before the skew of the paper sheet is corrected. That is, FIG. 11 illustrates a state where a paper sheet M1 is transported to a position immediately before the pair of correction rollers 260 by the group of pairs of first transportation rollers 210.

Figure 12:
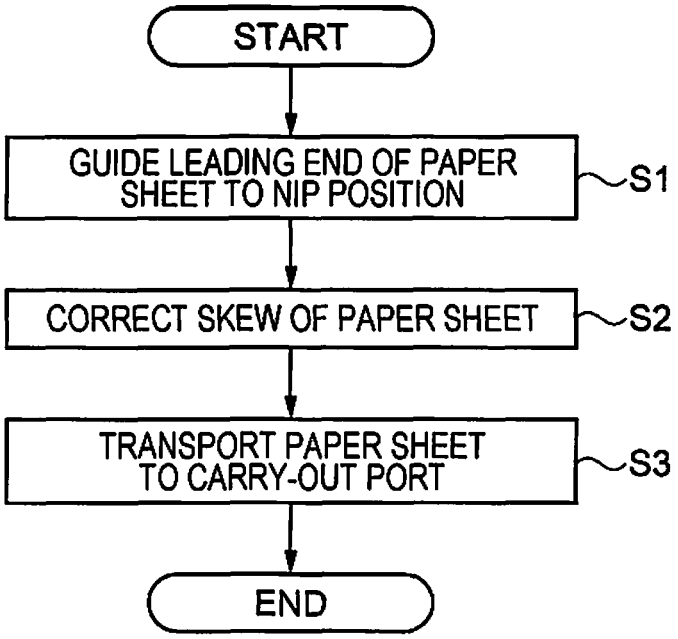
FIG. 12 is a process flowchart illustrating a method of correcting the skew of the paper sheet.
Figure 13:
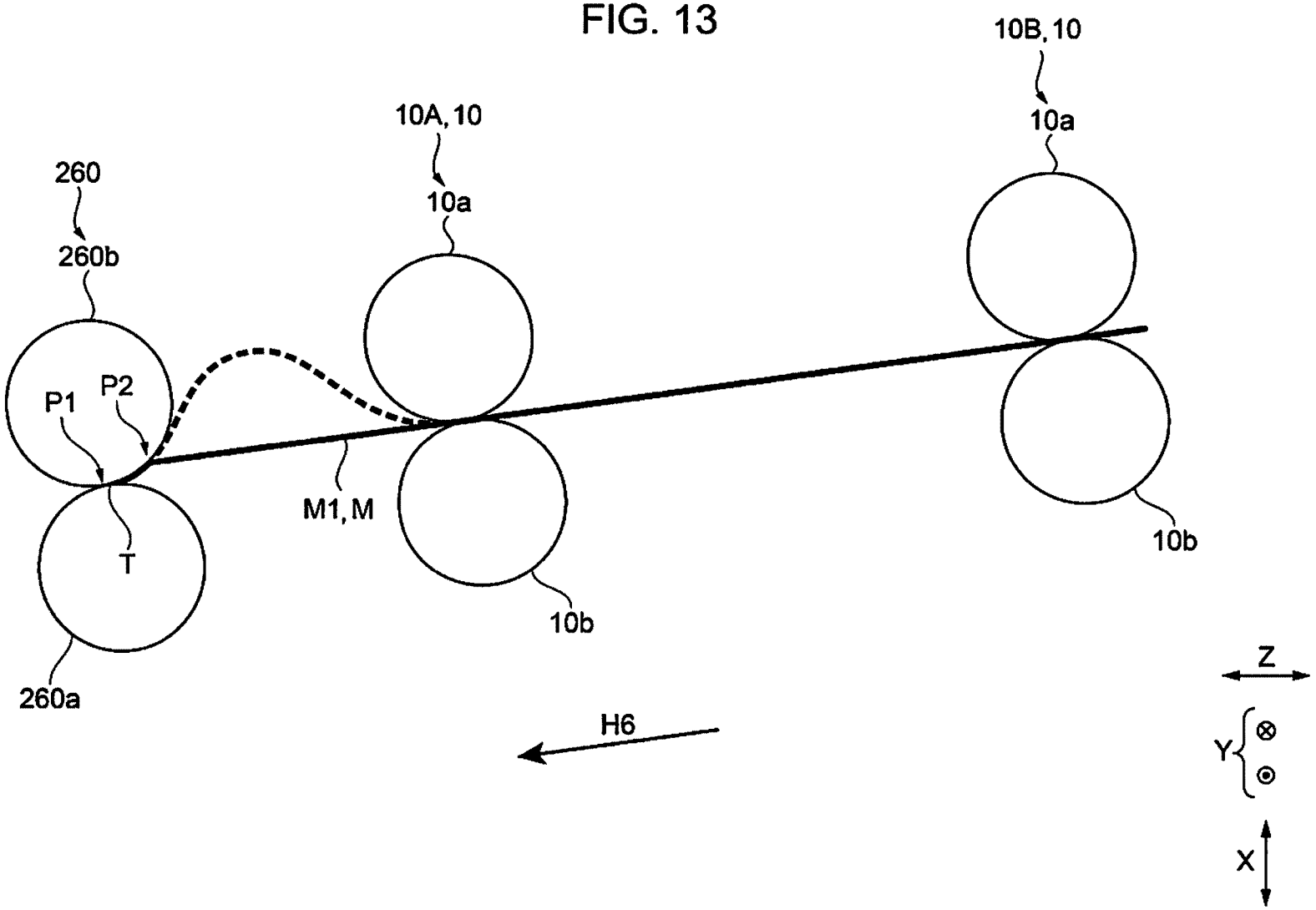
FIG. 13 is a schematic view illustrating a state of a process illustrated in FIG. 12.
Figure 14:
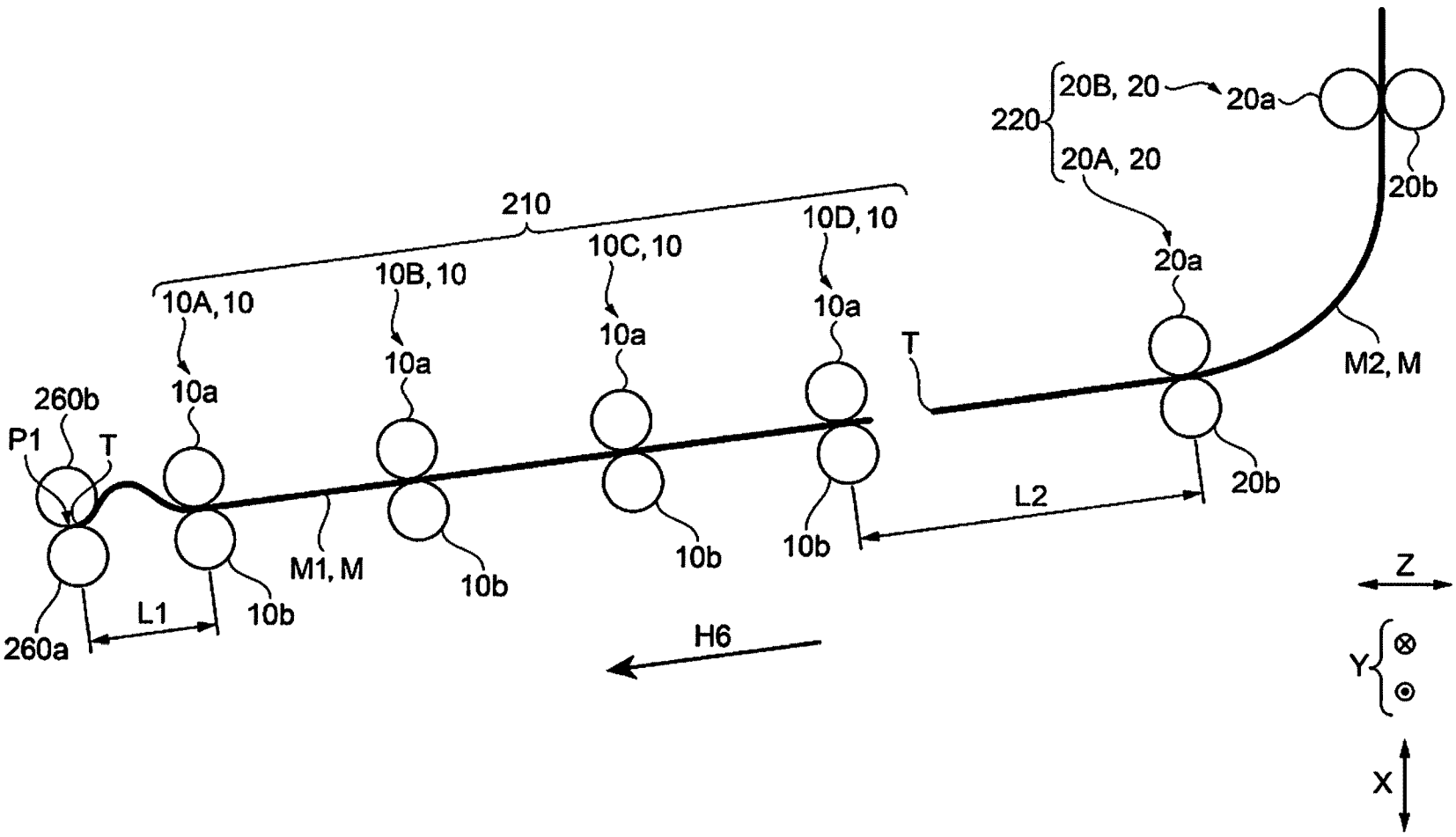
FIG. 14 is a schematic view illustrating a state of the process illustrated in FIG. 12.
Figure 15:
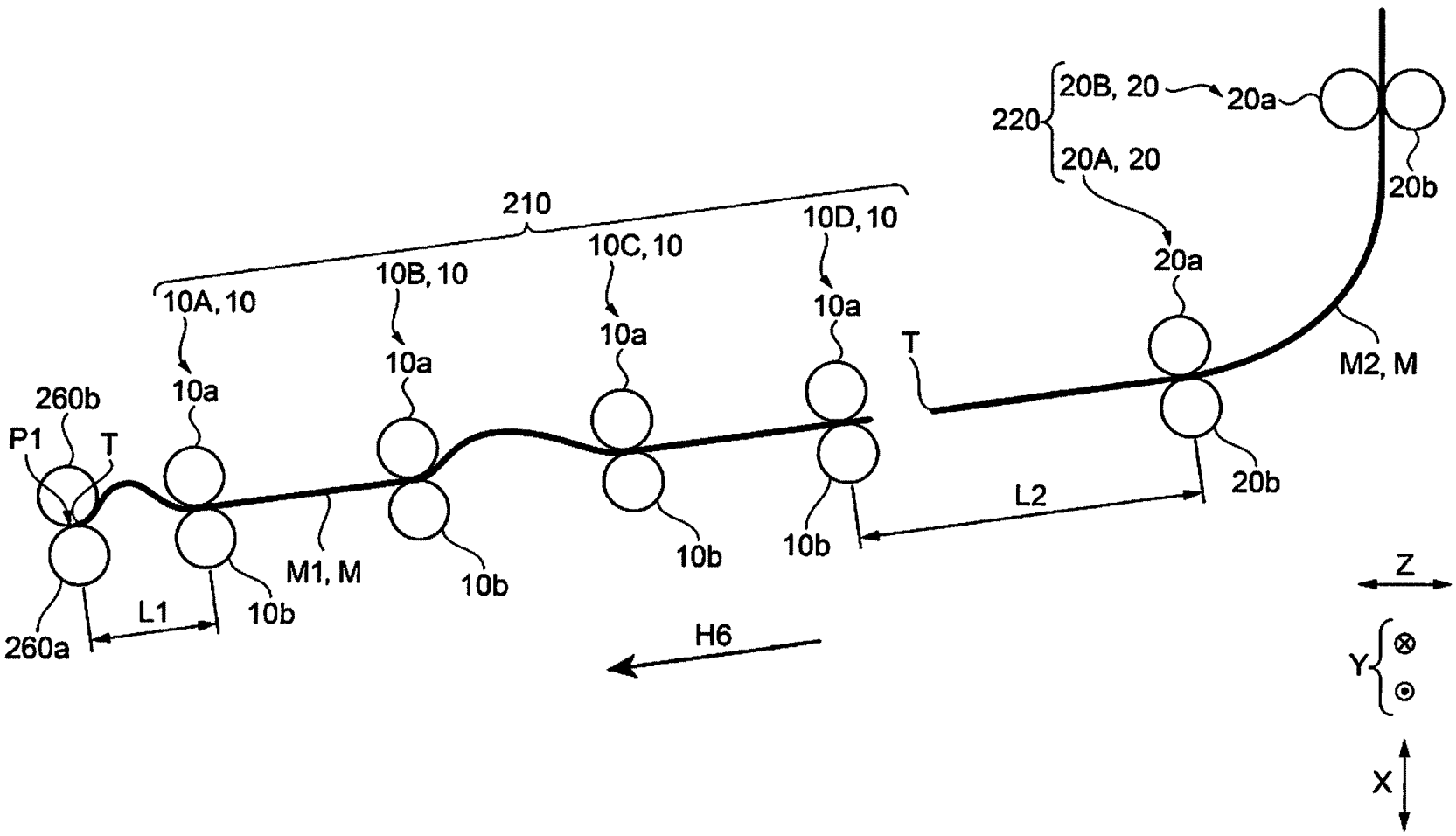
FIG. 15 is a schematic view illustrating a state of the process illustrated in FIG. 12.

FIG. 12 is a process flowchart illustrating a method of correcting the skew of the paper sheet. FIG. 13 is a partial enlarged view of FIG. 11 and is a schematic view illustrating the state of a process illustrated in FIG. 12. FIGS. 14 and 15 are views corresponding to FIG. 13 and are schematic views illustrating the state of the process illustrated in FIG. 12.

Note that, in FIGS. 11, 13, 14, and 15, for the sake of clarification of the state, the driving rollers 10*a*, 20*a*, and 260*a* and the driven rollers 10*b*, 20*b*, and 260*b* are illustrated with circles having the same size.

As illustrated in FIG. 11, on the upstream side of the pair of correction rollers 260 in the transportation direction H6 of the paper sheet M, a pair of first transportation rollers 10A, a pair of first transportation rollers 10B, a pair of first transportation rollers 10C, a pair of first transportation rollers 10D, a pair of second transportation rollers 20A, and a pair of second transportation rollers 20B are sequentially disposed. The group of pairs of first transportation rollers 210 is configured of the pair of first transportation rollers 10A, the pair of first transportation rollers 10B, the pair of first transportation rollers 10C, and the pair of first transportation rollers 10D and a portion of the group of pairs of second transportation rollers 220 is configured of the pair of second transportation rollers 20A and the pair of second transportation rollers 20B.

The paper sheet M1 is transported in the transportation direction H6 by the group of pairs of first transportation rollers 210 and the leading end T of the paper sheet M1 is disposed immediately before the pair of correction rollers 260. Since the paper sheet M1 is transported in a direction oblique with respect to the transportation direction H6, the leading end T of the paper sheet M1 intersects a direction orthogonal to the transportation direction H6.

That is, in a case where the skew of the paper sheet M1 does not occur and the paper sheet M1 is transported in the transportation direction H6, the leading end T of the paper sheet M1 is orthogonal to the transportation direction H6. In a case where the paper sheet M1 is transported in a direction oblique with respect to the transportation direction H6 and the skew of the paper sheet M1 occurs, the leading end T of the paper sheet M1 intersects a direction orthogonal to the transportation direction H6.

The next paper sheet M2 is transported in the transportation direction H6 by the group of pairs of second transportation rollers 220. The leading end T of the next paper sheet M2 is disposed so as to protrude from the pair of second transportation rollers 20A to the group of pairs of first transportation rollers 210 side.

As illustrated in FIG. 12, a method of correcting the skew of the paper sheet M includes a process (Step S1) of guiding the leading end T of the paper sheet M to a nip position P1 of the pair of correction rollers 260, a process (Step S2) of correcting the skew of the paper sheet M at the nip position P1, and a process (Step S3) of transporting the paper sheet M of which the skew has been corrected toward the carry-out port 293.

In Step S1, the pair of correction rollers 260 (driving roller 260*a*) is stopped, the group of pairs of first transportation rollers 210 (first driving roller 10*a*) is driven, and a force in the transportation direction H6 from the group of pairs of first transportation rollers 210 is applied to the paper sheet M1.

As illustrated in FIG. 13, the paper sheet M is transported in the transportation direction H6 by the group of pairs of first transportation rollers 210 and the leading end T of the paper sheet M1 comes into contact with a position P2 of the driven roller 260*b* of the pair of correction rollers 260 for the first time. Since the driven roller 260*b* is configured with a material with a high slidability, the leading end T of the paper sheet M1 slides on the flat surface of the driven roller 260*b* due to the force in the transportation direction H6 and is guided to the nip position P1 of the pair of correction rollers 260.

That is, the driven roller 260*b* includes a flat surface and in a case where the skew of the paper sheet M is corrected, the driven roller 260*b* causes the leading end T of the paper sheet M (end of paper sheet M) to slide thereon so that the paper sheet M is guided to the nip position P1 at which the paper sheet M is nipped between the driving roller 260*a* and the driven roller 260*b*.

In Step S2, when the leading end T of the paper sheet M is guided to the nip position P1 of the pair of correction rollers 260, connection between the first driving roller 10*a* and the motor is released in the order of the pair of first transportation rollers 10D, the pair of first transportation rollers 10C, the pair of first transportation rollers 10B, and the pair of first transportation rollers 10A so that the first driving roller 10*a* transitions into an idle state and the forces in the transportation direction H6 being applied to the paper sheet M from the pairs of first transportation rollers 10A, 10B, 10C, and 10D are sequentially released.

Note that, in the pair of first transportation rollers 10A and the pair of first transportation rollers 10B, the pair of first transportation rollers 10A is an example of a "downstream side pair of first transportation rollers" and the pair of first transportation rollers 10B is an example of an "upstream side pair of first transportation rollers". In the pair of first transportation rollers 10B and the pair of first transportation rollers 10C, the pair of first transportation rollers 10B is an example of the "downstream side pair of first transportation rollers" and the pair of first transportation rollers 10C is an example of the "upstream side pair of first transportation rollers". In the pair of first transportation rollers 10C and the pair of first transportation rollers 10D, the pair of first transportation rollers 10C is an example of the "downstream side pair of first transportation rollers" and the pair of first transportation rollers 10D is an example of the "upstream side pair of first transportation rollers".

That is, in a case where the skew of the paper sheet M is corrected, a force in the transportation direction H6 being applied to the paper sheet M from the "upstream side pair of first transportation rollers" is released earlier and a force in the transportation direction H6 being applied to the paper sheet M from the "downstream side pair of first transportation rollers" is released later.

Since the force in the transportation direction H6 from the group of pairs of first transportation rollers 210 is applied to the paper sheet M1, as illustrated with a broken line in FIG. 13 and a solid line in FIG. 14, the paper sheet M1 warps rightwards in the transverse direction X at a position between the pair of correction rollers 260 and the pair of first transportation rollers 10A and the leading end T of the paper sheet M1 is pressed against the nip position P1 of the pair of correction rollers 260.

Since the nip position P1 of the pair of correction rollers 260 is orthogonal to the transportation direction H6, if the leading end T of the paper sheet M1 is pressed against the nip position P1 of the pair of correction rollers 260, the leading end T of the paper sheet M1 is disposed in a direction along the nip position P1 of the pair of correction rollers 260, that is, in a direction orthogonal to the transportation direction H6.

As described above, in Step S2, a state where the leading end T of the paper sheet M1 intersects a direction orthogonal to the transportation direction H6 (state where there is skew of paper sheet M) is corrected to a state where the leading end T of the paper sheet M1 is orthogonal to the transportation direction H6 (state where skew of paper sheet M has been corrected).

As described above, the teeth 77 are provided on the circumferential surface of the driving roller 260*a* such that the positions of the teeth 77 are misaligned and the teeth 77 do not completely overlap each other when seen in the direction Y (refer to FIG. 7).

If the teeth 77 are provided on the circumferential surface of the driving roller 260*a* such that the teeth 77 overlap each other when seen in the direction Y, the leading end T of the paper sheet M which comes into contact with the pair of correction rollers 260 intrudes into an area between the tooth 77 and the tooth 77 of the driving roller 260*a* and thus the leading end T is not guided to the nip position P1 of the pair of correction rollers 260. Therefore, it may not be possible to appropriately correct the skew of the paper sheet M.

According to the present embodiment, since the teeth 77 are provided such that the teeth 77 do not completely overlap each other, the leading end T of the paper sheet M is not likely to intrude into an area between the tooth 77 and the tooth 77 of the driving roller 260*a* and thus the leading end T is stably guided to the nip position P1 of the pair of correction rollers 260. Therefore, it is possible to appropriately correct the skew of the paper sheet M.

If connection between the pair of first transportation rollers 10B, which is an example of the "downstream side pair of first transportation rollers", and the motor is released earlier and connection between the pair of first transportation rollers 10C, which is an example of the "upstream side pair of first transportation rollers", and the motor is released later, as illustrated in FIG. 15, the paper sheet M1 warps not only at a position between the pair of correction rollers 260 and the pair of first transportation rollers 10A but also at a position between the pair of first transportation rollers 10B and the pair of first transportation rollers 10C. Therefore, transportation failure such as a jam of the paper sheet M1 becomes likely to occur between the pair of first transportation rollers 10B and the pair of first transportation rollers 10C.

Accordingly, in a case of correcting the skew of the paper sheet M1, it is preferable that the forces in the transportation direction H6 applied to the paper sheet M1 from the pairs of first transportation rollers 10 be released sequentially in such a manner that the more distant the pair of first transportation rollers 10 is from the pair of correction rollers 260, the earlier the force is released. That is, in a case of correcting the skew of the paper sheet M, it is preferable that the force in the transportation direction H6 applied to the paper sheet M from the "upstream side pair of first transportation rollers" be released earlier and the force in the transportation direction H6 applied to the paper sheet M from the "downstream side pair of first transportation rollers" be released later.

In Step S3, the pair of correction rollers 260 is rotated with the driving roller 260*a* being driven so that the paper sheet M of which the skew has been corrected is transported toward the carry-out port 293.

Thereafter, Step S1 and Step S2 are executed with respect to the next paper sheet M2 so as to correct the skew of the next paper sheet M2.

Returning to FIG. 14, in Step S2, the group of pairs of second transportation rollers 220 continues to be driven. That is, even while transportation of the paper sheet M1 in the transportation direction H6 is inhibited by the pair of correction rollers 260, the next paper sheet M2 is transported in the transportation direction H6 by the group of pairs of second transportation rollers 220.

The distance L2 between the group of pairs of first transportation rollers 210 and the group of pairs of second transportation rollers 220 is greater than the distance L1 between the group of pairs of first transportation rollers 210 and the pair of correction rollers 260 and the distance L2 is set such that the next paper sheet M2 does not interfere with the paper sheet M1 in a case where the next paper sheet M2 is transported in the transportation direction H6 while the transportation of the paper sheet M1 in the transportation direction H6 is inhibited.

Accordingly, in Step S2, in a case where the transportation of the paper sheet M1 in the transportation direction H6 is inhibited by the pair of correction rollers 260 and the next paper sheet M2 is transported in the transportation direction H6 by the group of pairs of second transportation rollers 220, the next paper sheet M2 does not come close to the paper sheet M1 and does not interfere with the paper sheet M1.

Accordingly, it is not necessary to stop the transportation of the paper sheet M performed by the group of pairs of second transportation rollers 220 in Step S2 and thus it is possible to improve the transportation ability for the paper sheet M in the transportation path 201 in comparison with a case where the transportation of the paper sheet M performed by the group of pairs of second transportation rollers 220 is stopped.

Therefore, it is preferable that the distance L2 between the group of pairs of first transportation rollers 210 and the group of pairs of second transportation rollers 220 be greater than the distance L1 between the pair of correction rollers 260 and the group of pairs of first transportation rollers 210.

As described above, the pair of correction rollers 260 is disposed close to the carry-out port 293 so that the leading end T of the paper sheet M reaches the carry-out port 293 while the paper sheet M is transported by being nipped by the pair of correction rollers 260. As a result, the skew of the paper sheet M, which occurs when the paper sheet M is transported along the transportation paths 201*a* and 201*b*, is corrected by the pair of correction rollers 260 in the vicinity of the carry-out port 293. Therefore, the paper sheets M of which the skew has been corrected transported into the post processing unit 300 through the carry-out port 293 and the paper sheets M are mounted on the stacker 328 in the post processing unit 300 in a state of being aligned. Therefore, it is possible for the post processing portion 325 to appropriately perform the post processing on the paper sheets M mounted on the stacker 328.

Furthermore, the pair of correction rollers 260 is disposed such that the leading end T of the paper sheet M reaches the pair of first post processing transportation rollers 327A while the paper sheet M is transported by being nipped by the pair of correction rollers 260. In other words, the pair of correction rollers 260 is disposed at such a distance that both of the pair of correction rollers 260 and the pair of first post processing transportation rollers 327A can nip the paper sheet M in a case where the paper sheet M of which the skew has been corrected by the pair of correction rollers 260 is transported toward the stacker 328 (post processing portion 325).

Specifically, the pair of correction rollers 260 is disposed at a such distance that both of the pair of correction rollers 260 and the pair of first post processing transportation rollers 327A also can nip the paper sheet M which is shortest in the transportation direction in a case where there are various kinds of paper sheets M which are different in length in the transportation direction.

For example, the pair of correction rollers 260 is disposed at a such distance that both of the pair of correction rollers 260 and the pair of first post processing transportation rollers 327A can nip the paper sheet M even in a case where the size of the paper sheet M is A4 and the paper sheet M is transported in a state where the long sides of the paper sheet M are disposed in a direction intersecting the transportation direction from the pair of correction rollers 260 to the pair of first post processing transportation rollers 327A and the short sides of the paper sheet M are disposed in a direction parallel to the transportation direction from the pair of correction rollers 260 to the pair of first post processing transportation rollers 327A (case where A4-sized paper sheet M is subject to transverse transportation). That is, the distance between the pair of correction rollers 260 and the pair of first post processing transportation rollers 327A is smaller than the length of the short sides of the A4-sized paper sheet M.

As a result, the paper sheet M of which the skew has been corrected by the pair of correction rollers 260 is nipped by both of the pair of correction rollers 260 on the intermediate unit 200 side and the pair of first post processing transportation rollers 327A on the post processing unit 300 side and the paper sheet M is transported to the stacker 328 on the post processing unit 300 side in a state where the skew thereof has been corrected reliably. As a result, the paper sheet M of which the skew has been corrected is reliably transported into the stacker 328 on the post processing unit 300 side and it is possible for the post processing portion 325 on the post processing unit 300 side to reliably perform the appropriate post processing on the paper sheet M mounted on the stacker 328.

The invention is not limited to the above-described embodiment and can be appropriately modified within a scope of the gist or idea of the invention which can be found from the claims and the entire specification and various modification examples other than the above-described embodiment can be conceived. Hereinafter, the modification examples will be described.

Modification Example 1

In the above-described embodiment, the intermediate unit 200 includes the switching back paths 204 and 207. However, the invention is not limited to this.

The intermediate unit 200 may not include the switching back paths 204 and 207. For example, a configuration in which the switching back paths 204 and 207 are provided in the printing unit 100 may be adopted instead of a configuration in which the switching back paths 204 and 207 are provided in the intermediate unit 200.

For example, the intermediate unit 200 may include the carry-in port 292 through which the paper sheet M is transported into the intermediate unit from the printing unit 100 that ejects ink on the paper sheet M to print an image on the paper sheet M, the carry-out port 293 through which the paper sheet M is transported to the post processing unit 300 that performs post processing on the paper sheet M, and a transportation path that is disposed between the carry-in port 292 and the carry-out port 293 and is provided with a drying path in which ink is dried.

Modification Example 2

In the above-described embodiment, the post processing device 500 is configured of the intermediate unit 200 and the post processing unit 300 and the intermediate unit 200 includes the carry-out port 293 through which the paper sheet M is transported to the post processing unit 300. However, the invention is not limited to this.

For example, the post processing device 500 may have a configuration in which the carry-out port 293 is not provided and the intermediate unit 200 and the post processing unit 300 are integrally formed with each other, for example, a configuration in which the groups of pairs of transportation rollers 210, 220, 230, 240, and 250 and the pair of correction rollers 260, which constitute the transportation path 201, the stacker 328, and the post processing portion 325 are disposed in the same housing.

Modification Example 3

In the above-described embodiment, the printing apparatus 1000 is configured of the printing unit 100, the intermediate unit 200, and the post processing unit 300 and the intermediate unit 200 includes the carry-in port 292 through which the paper sheet M is transported into the intermediate unit from the printing unit 100 and the carry-out port 293 through which the paper sheet M is transported to the post processing unit 300. However, the invention is not limited to this.

For example, the printing apparatus 1000 may have a configuration in which the carry-in port 292 and the carry-out port 293 are not provided and the printing unit 100, the intermediate unit 200, and the post processing unit 300 are integrally formed with each other, for example, a configuration in which the printing portion 110 that ejects ink to print an image on the paper sheet M, the groups of pairs of transportation rollers 210, 220, 230, 240, and 250, the pair of correction rollers 260, the stacker 328, and the post processing portion 325 are disposed in the same housing.

Modification Example 4

In the above-described embodiment, the roller 265 of the driving roller 260*a* has the same configuration as the roller portion 17 (refer to FIG. 6) of the first driven roller 10*b*. However, the roller 265 may have the same configuration as the rubber roller portion 12 of the first driving roller 10*a*. That is, the driving roller 260*a* may include a rough surface with the ceramic particles 15 provided thereon.

Even in a case where the driving roller 260*a* includes a rough surface with the ceramic particles 15 provided thereon, it is possible to achieve the same effect as the above-described embodiment that the paper sheet M is stable transported and undried ink is not likely to be transferred.

Modification Example 5

Ink which adheres to the rear surface of the paper sheet M as a result of duplex printing on the paper sheet M is dried at a position on the downstream side in the transportation direction in the transportation path 201. Accordingly, undried ink is not likely to remain on the rear surface side of the paper sheet M. Therefore, at a position on the downstream side in the transportation direction in the transportation path 201, even if the driving roller 1 comes into surface contact with the rear surface of the paper sheet M, the driving roller 1 is not likely to be contaminated with undried ink.

Accordingly, a configuration in which the driving roller 1 can come into surface contact with the rear surface of the paper sheet M at a position on the downstream side in the transportation direction in the transportation path 201 may be adopted. That is, the driving roller 1 may be configured of the driving shaft 11 and the rubber roller portion 12 inserted onto the driving shaft 11 and the rough surface portion 13 covering the rubber roller portion 12 may be omitted.

For example, each of the first driving roller 10*a* and the second driving roller 20*a* may be configured of the driving shaft 11 and the rubber roller portion 12 inserted onto the driving shaft 11 and the rough surface portion 13 covering the rubber roller portion 12 may be omitted.

For example, the first driving roller 10*a* of each of the pairs of first transportation rollers 10A and 10B in the group of pairs of first transportation rollers 210 may be configured of the driving shaft 11 and the rubber roller portion 12 inserted onto the driving shaft 11 and the first driving roller 10*a* of each of the pairs of first transportation rollers 10C and 10D in the group of pairs of first transportation rollers 210 may be configured of the driving shaft 11, the rubber roller portion 12 inserted onto the driving shaft 11, and the rough surface portion 13.

It is possible to achieve a reduction in cost of the driving roller 1 when omitting the rough surface portion 13.

Modification Example 6

In the above-described embodiment, the printing head 111 which the printing portion 110 includes is not limited to a line-head type printing head and the printing head 111 may be a serial head type printing head which can move along the width direction intersecting the transportation direction of the paper sheet M.

Modification Example 7

In the above-described embodiment, the printing apparatus may be a fluid ejecting apparatus which ejects or discharges fluid other than ink (liquid substance which is obtained by dispersing or mixing functional material particles into liquid or gel-like fluid substance) to perform printing. For example, the printing apparatus may be a liquid substance ejecting apparatus which ejects a liquid substance, in which materials such as electrode materials and coloring materials (pixel material) used for manufacturing a liquid crystal display, an electroluminescence (EL) display, and a planar light emission display are included while being dispersed or dissolved therein. In addition, the printing apparatus may be a fluid substance ejecting apparatus which ejects a fluid substance such as gel (for example, physical gel). In addition, the invention can be applied to any one of those fluid ejecting apparatuses. Note that, in the specification, "fluid" does not include fluid consisting only of gas and examples of fluid include liquid (including inorganic solvent, organic solvent, solution, liquid resin, liquid metal (metallic melt), or like), a liquid substance, and a fluid substance.

The entire disclosure of Japanese Patent Application No.: 2017-089383, filed Apr. 28, 2017, No.: 2016-138257, filed Jul. 13, 2016 are expressly incorporated by reference herein.

What is claimed is:

1. An intermediate unit comprising:

a carry-in port through which a medium is transported into the intermediate unit from a printing unit that ejects liquid to print an image on the medium;

a carry-out port through which the medium is transported to a post processing unit that performs post processing on the medium; and a transportation path that is disposed between the carry-in port and the carry-out port, wherein the transportation path is provided with a group of pairs of first transportation rollers that is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller, and a pair of correction rollers that is positioned on the downstream side of the group of pairs of first transportation rollers in the transportation direction and corrects skew of the medium with respect to the transportation direction, wherein the pair of correction rollers includes a first roller which rotates in a direction in which the medium is transported toward the carry-out port and a second roller which is rotated in accordance with the rotation of the first roller with the medium nipped between the first roller and the second roller, and wherein the first roller includes a convex portion that protrudes from a surface of the first roller and that comes into point contact with the medium.

2. The intermediate unit according to claim 1, wherein the pair of correction rollers is disposed such that, when the medium is transported with a short side of the medium being parallel to the transportation direction, a leading end of the short side of the medium reaches the carry-out port while the short side of the medium is transported by being nipped by the pair of correction rollers.

3. The intermediate unit according to claim 2, wherein the group of pairs of first transportation rollers is configured of a plurality of pairs of first transportation rollers which are driven by the same motor, wherein the group of pairs of first transportation rollers includes an upstream side pair of first transportation rollers which is disposed on the upstream side of the pair of correction rollers in the transportation direction, and a downstream side pair of first transportation rollers which is disposed on the upstream side of the pair of correction rollers in the transportation direction and is disposed on the downstream side of the upstream side pair of first transportation rollers in the transportation direction, and wherein, in a case where the skew is corrected, a transportation force which is applied to the medium by the downstream side pair of first transportation rollers is released after a transportation force which is applied to the medium by the upstream side pair of first transportation rollers is released.

4. The intermediate unit according to claim 3, further comprising:

a group of pairs of second transportation rollers that is disposed on the upstream side of the group of pairs of first transportation rollers in the transportation direction and in which a plurality of pairs of transportation rollers that are driven by the same motor are disposed, wherein a distance between a pair of first transportation rollers which is disposed on the most upstream side in the group of pairs of first transportation rollers and a pair of second transportation rollers which is disposed on the most downstream side in the group of pairs of second transportation rollers is greater than a distance between a pair of first transportation rollers which is disposed on the most downstream side in the group of pairs of first transportation rollers and the pair of correction rollers.

5. A post processing device comprising:

the intermediate unit according to claim 1;

a mounting portion that is disposed on the downstream side of the intermediate unit in the transportation direction and on which the medium transported out of the carry-out port is mounted; and a post processing unit that includes a post processing portion which performs post processing on the medium mounted on the mounting portion.

6. A printing apparatus comprising:

the post processing device according to claim 5; and a printing unit that is disposed on the upstream side of the post processing device in the transportation direction and ejects liquid to print an image on the medium.

7. A post processing device comprising:

the intermediate unit according to claim 3;

a mounting portion that is disposed on the downstream side of the intermediate unit in the transportation direction and on which the medium transported out of the carry-out port is mounted; and a post processing unit that includes a post processing portion which performs post processing on the medium mounted on the mounting portion.

8. A printing apparatus comprising:

the post processing device according to claim 7; and a printing unit that is disposed on the upstream side of the post processing device in the transportation direction and ejects liquid to print an image on the medium.

9. A post processing device comprising:

the intermediate unit according to claim 4;

a mounting portion that is disposed on the downstream side of the intermediate unit in the transportation direction and on which the medium transported out of the carry-out port is mounted; and a post processing unit that includes a post processing portion which performs post processing on the medium mounted on the mounting portion.

10. A printing apparatus comprising:

the post processing device according to claim 9; and a printing unit that is disposed on the upstream side of the post processing device in the transportation direction and ejects liquid to print an image on the medium.

11. A post processing device comprising:

the intermediate unit according to claim 2;

a mounting portion that is disposed on the downstream side of the intermediate unit in the transportation direction and on which the medium transported out of the carry-out port is mounted; and a post processing unit that includes a post processing portion which performs post processing on the medium mounted on the mounting portion.

12. A printing apparatus comprising:

the post processing device according to claim 11; and a printing unit that is disposed on the upstream side of the post processing device in the transportation direction and ejects liquid to print an image on the medium.

13. A post processing device comprising:

the intermediate unit according to claim 2;

a mounting portion that is disposed on the downstream side of the intermediate unit in the transportation direction and on which the medium transported out of the carry-out port is mounted; and a post processing unit that includes a post processing portion which performs post processing on the medium mounted on the mounting portion.

14. A printing apparatus comprising:

the post processing device according to claim 13; and a printing unit that is disposed on the upstream side of the post processing device in the transportation direction and ejects liquid to print an image on the medium.

15. A post processing device comprising:

a group of pairs of transportation rollers that transports a medium, which is transported into the post processing device from a printing unit that ejects liquid to print an image on the medium, in a transportation direction and is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller;

a mounting portion on which the medium is mounted; and a post processing portion that performs post processing on the medium mounted on the mounting portion, wherein a pair of correction rollers that corrects skew of the medium with respect to the transportation direction is provided between, the group of pairs of transportation rollers and the mounting portion, wherein the pair of correction rollers include a first roller which rotates in a direction in which the medium is transported toward the mounting portion and a second roller which is rotated in accordance with the rotation of the first roller with the medium nipped between the first roller and the second roller, and wherein the first roller includes a convex portion that protrudes from a surface of the first roller and that comes into point contact with the medium.

16. The post processing device according to claim 15, further comprising:

a pair of mounting portion side transportation rollers that is provided between the group of pairs of transportation rollers and the mounting portion, wherein the pair of correction rollers is disposed such that, when the medium is transported with a short side of the medium being parallel to the transportation direction, a leading end of the short side of the medium reaches the pair of mounting portion side transportation rollers while the short side of the medium is transported by being nipped by the pair of correction rollers.

17. A printing apparatus comprising:

the post processing device according to claim 16; and a printing unit that is disposed on the upstream side of the post processing device in the transportation direction and ejects liquid to print an image on the medium.

18. A printing apparatus comprising:

the post processing device according to claim 15; and a printing unit that is disposed on the upstream side of the post processing device in the transportation direction and ejects liquid to print an image on the medium.

19. A printing apparatus comprising:

a printing portion that ejects liquid to print an image on a medium;

a group of pairs of transportation rollers that is provided with a plurality of pairs of transportation rollers, each of which includes a driving roller that applies a transportation force in a transportation direction to the medium fed from the printing portion and a driven roller that is rotated in accordance with the rotation of the driving roller with the medium nipped between the driving roller and the driven roller;

a mounting portion on which the medium is mounted; and a post processing portion that performs post processing on the medium mounted on the mounting portion, wherein a pair of correction rollers that corrects skew of the medium with respect to the transportation direction is provided between the group of pairs of transportation rollers and the mounting portion, wherein the pair of correction rollers include a first roller which rotates in a direction in which the medium is transported toward the mounting portion and a second roller which is rotated in accordance with the rotation of the first roller with the medium nipped between the first roller and the second roller, and wherein the first roller includes a convex portion that protrudes from a surface of the first roller and that comes into point contact with the medium.

20. An intermediate unit comprising:

a carry-in port through which a medium is transported into the intermediate unit from a printing unit that ejects liquid to print an image on the medium;

a carry-out port through which the medium is transported to a post processing unit that performs post processing on the medium; and a transportation path that is disposed between the carry-in port and the carry-out port, wherein the transportation path is provided with a group of pairs of first transportation rollers that is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller, and a pair of correction rollers that is positioned on the downstream side of the group of pairs of first transportation rollers in the transportation direction and corrects skew of the medium with respect to the transportation direction, wherein the group of pairs of first transportation rollers is configured of a plurality of pairs of first transportation rollers which are driven by the same motor, wherein the group of pairs of first transportation rollers includes an upstream side pair of first transportation rollers which is disposed on the upstream side of the pair of correction rollers in the transportation direction, and a downstream side pair of first transportation rollers which is disposed on the upstream side of the pair of correction rollers in the transportation direction and is disposed on the downstream side of the upstream side pair of first transportation rollers in the transportation direction, and wherein, in a case where the skew is corrected, a transportation force which is applied to the medium by the downstream side pair of first transportation rollers is released after a transportation force which is applied to the medium by the upstream side pair of first transportation rollers is released.

21. A post processing device comprising:

a group of pairs of transportation rollers that transports a medium, which is transported into the post processing device from a printing unit that ejects liquid to print an image on the medium, in a transportation direction and is provided with a plurality of pairs of transportation rollers, each of which includes a driving roller that applies a transportation force in a transportation direction to the medium and a driven roller that is rotated in accordance with the rotation of the driving roller with the medium nipped between the driving roller and the driven roller;

a mounting portion on which the medium is mounted; and a post processing portion that performs post processing on the medium mounted on the mounting portion, wherein a pair of correction rollers that corrects skew of the medium with respect to the transportation direction is provided between the group of pairs of transportation rollers and the mounting portion, wherein the group of pairs of transportation rollers is configured of a plurality of pairs of transportation rollers which are driven by the same motor, wherein the group of pairs of transportation rollers includes an upstream side pair of transportation rollers which is disposed on the upstream side of the pair of correction rollers in the transportation direction, and a downstream side pair of transportation rollers which is disposed on the upstream side of the pair of correction rollers in the transportation direction and is disposed on the downstream side of the upstream side pair of transportation rollers in the transportation direction, and wherein, in a case where the skew is corrected, a transportation force which is applied to the medium by the downstream side pair of transportation rollers is released after a transportation force which is applied to the medium by the upstream side pair of transportation rollers is released.

22. A printing apparatus comprising:

a printing portion that ejects liquid to print an image on a medium;

a group of pairs of transportation rollers that is provided with a plurality of pairs of transportation rollers, each of which includes a driving roller that applies a transportation force in a transportation direction to the medium fed from the printing portion and a driven roller that is rotated in accordance with the rotation of the driving roller with the medium nipped between the driving roller and the driven roller;

a mounting portion on which the medium is mounted; and a post processing portion that performs post processing on the medium mounted on the mounting portion, wherein a pair of correction rollers that corrects skew of the medium with respect to the transportation direction is provided between the group of pairs of transportation rollers and the mounting portion, wherein the group of pairs of transportation rollers is configured of a plurality of pairs of transportation rollers which are driven by the same motor, wherein the group of pairs of transportation rollers includes an upstream side pair of transportation rollers which is disposed on the upstream side of the pair of correction rollers in the transportation direction, and a downstream side pair of transportation rollers which is disposed on the upstream side of the pair of correction rollers in the transportation direction and is disposed on the downstream side of the upstream side pair of transportation rollers in the transportation direction, and wherein, in a case where the skew is corrected, a transportation force which is applied to the medium by the downstream side pair of transportation rollers is released after a transportation force which is applied to the medium by the upstream side pair of transportation rollers is released.

* * * * *